US009449571B2

(12) United States Patent
Takahashi et al.

(10) Patent No.: US 9,449,571 B2
(45) Date of Patent: Sep. 20, 2016

(54) DISPLAY DEVICE DRIVING METHOD, DISPLAY DEVICE, AND LIQUID CRYSTAL DISPLAY DEVICE

(71) Applicant: Sharp Kabushiki Kaisha, Osaka-shi, Osaka (JP)

(72) Inventors: Kazuki Takahashi, Osaka (JP); Akizumi Fujioka, Osaka (JP); Taketoshi Nakano, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 32 days.

(21) Appl. No.: 14/409,613

(22) PCT Filed: Apr. 26, 2013

(86) PCT No.: PCT/JP2013/062444
§ 371 (c)(1),
(2) Date: Dec. 19, 2014

(87) PCT Pub. No.: WO2014/002607
PCT Pub. Date: Jan. 3, 2014

(65) Prior Publication Data

US 2016/0012787 A1 Jan. 14, 2016

(30) Foreign Application Priority Data

Jun. 29, 2012 (JP) ..... 2012-147911

(51) Int. Cl.
*G09G 3/36* (2006.01)

(52) U.S. Cl.
CPC ..... *G09G 3/3614* (2013.01); *G09G 3/3622* (2013.01); *G09G 3/3648* (2013.01); *G09G 3/3696* (2013.01); *G09G 2320/02* (2013.01); *G09G 2320/103* (2013.01); *G09G 2330/021* (2013.01); *G09G 2340/16* (2013.01)

(58) Field of Classification Search
CPC ..... G09G 3/3614; G09G 3/3648
See application file for complete search history.

(56) References Cited

U.S. PATENT DOCUMENTS 7,113,154 B1 * 9/2006 Inukai ..... G09G 3/2022 345/76
2002/0180673 A1 12/2002 Tsuda et al.
2007/0001963 A1 1/2007 Koma
2011/0115839 A1 5/2011 Takahashi et al.

(Continued)

FOREIGN PATENT DOCUMENTS

CN 1864093 A 11/2006
JP 2002-182619 A 6/2002
JP 2011-170327 A 9/2011

(Continued)

OTHER PUBLICATIONS

Official Communication issued in International Patent Application No. PCT/JP2013/062444, mailed on Aug. 6, 2013.

*Primary Examiner* — Ricardo L Osorio
(74) *Attorney, Agent, or Firm* — Keating & Bennett, LLP

(57) ABSTRACT

A timing controller carries out display refresh on a display panel in a first frame which comes one frame after a second frame in which (i) an image signal supplied from an interface matches an image signal stored in a frame memory and (ii) a polarity balance value is equal to a reference value. In this case, the image signal, having a polarity opposite to that of pixel applied voltages in the second frame, is supplied to the display panel in the first frame. This makes it possible to prevent a deterioration in the display panel while reducing electric power consumption.

14 Claims, 12 Drawing Sheets

(56) References Cited

U.S. PATENT DOCUMENTS

| | | | | |
|---|---|---|---|---|
| 2011/0175883 | A1 | 7/2011 | Toyotaka et al. | |
| 2011/0285759 | A1 | 11/2011 | Sakai | |
| 2013/0314360 | A1* | 11/2013 | Saitoh | G06F 3/0412 345/173 |
| 2014/0191989 | A1* | 7/2014 | Saitoh | G09G 3/3614 345/173 |

FOREIGN PATENT DOCUMENTS

| | | | |
|---|---|---|---|
| TW | 201207798 | A1 | 2/2012 |
| WO | 2010/106713 | A1 | 9/2010 |

* cited by examiner

FIG. 2

| FRAME NUMBER | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
|---|---|---|---|---|---|---|---|---|---|---|---|---|---|---|---|---|---|---|---|---|---|---|---|---|---|
| IMAGE IN INTERFACE | Z | A | A | A | A | A | B | B | B | B | B | B | B | B | B | B | B | B | B | B | B | B | B | B | B |
| IMAGE IN FRAME MEMORY | Z | Z | A | A | A | A | A | B | B | B | B | B | B | B | B | B | B | B | B | B | B | B | B | B | B |
| DISPLAY REFRESH | | | A | | | | | B | | | | | | B | | | | | | | | B | | | |
| DISPLAYED IMAGE | Z | Z | A | A | A | A | A | B | B | B | B | B | B | B | B | B | B | B | B | B | B | B | B | B | B |
| PIXEL VOLTAGE POLARITY | − | − | + | + | + | + | + | − | − | − | − | − | − | + | + | + | + | + | + | + | + | − | − | − | − |
| POLARITY BALANCE | 2 | 1 | 2 | 3 | 4 | 5 | 6 | 5 | 4 | 3 | 2 | 1 | 0 | 1 | 2 | 3 | 4 | 5 | 6 | 7 | 8 | 7 | 6 | 5 | 4 |

FIG. 6

| FRAME NUMBER | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
|---|---|---|---|---|---|---|---|---|---|---|---|---|---|---|---|---|---|---|---|---|---|---|---|---|---|
| IMAGE IN INTERFACE | Z | A | A | A | A | A | A | A | B | B | B | B | B | B | B | B | B | B | B | B | B | B | B | B | B |
| IMAGE IN FRAME MEMORY | Z | Z | A | A | A | A | A | A | A | B | B | B | B | B | B | B | B | B | B | B | B | B | B | B | B |
| DISPLAY REFRESH | | | A | | | | A | | | B | | | | | B | | | | | | | | B | | |
| DISPLAYED IMAGE | Z | Z | A | A | A | A | A | A | A | B | B | B | B | B | B | B | B | B | B | B | B | B | B | B | B |
| PIXEL VOLTAGE POLARITY | − | − | − | − | − | − | + | + | + | + | + | + | + | + | − | − | − | − | − | − | − | − | + | + | + |
| POLARITY BALANCE | 5 | 4 | 3 | 2 | 1 | 0 | 1 | 2 | 3 | 4 | 5 | 6 | 7 | 8 | 7 | 6 | 5 | 4 | 3 | 2 | 1 | 0 | 1 | 2 | 3 |

FIG. 7

| FRAME NUMBER | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
|---|---|---|---|---|---|---|---|---|---|---|---|---|---|---|---|---|---|---|---|---|---|---|---|---|---|
| IMAGE IN INTERFACE | Z | A | A | A | A | A | A | A | B | B | B | B | B | B | B | B | B | B | B | B | B | B | B | B | B |
| IMAGE IN FRAME MEMORY | Z | Z | A | A | A | A | A | A | A | B | B | B | B | B | B | B | B | B | B | B | B | B | B | B | B |
| DISPLAY REFRESH | | | A | A | A | | A | | | B | B | B | | | B | | | | | | | | B | | |
| DISPLAYED IMAGE | Z | Z | A | A | A | A | A | A | A | B | B | B | B | B | B | B | B | B | B | B | B | B | B | B | B |
| PIXEL VOLTAGE POLARITY | − | − | − | − | − | − | + | + | + | + | + | + | + | + | − | − | − | − | − | − | − | − | + | + | + |
| POLARITY BALANCE | 5 | 4 | 3 | 2 | 1 | 0 | 1 | 2 | 3 | 4 | 5 | 6 | 7 | 8 | 7 | 6 | 5 | 4 | 3 | 2 | 1 | 0 | 1 | 2 | 3 |

FIG. 8

| FRAME NUMBER | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 |
|---|---|---|---|---|---|---|---|---|---|---|---|---|---|---|---|---|---|---|---|---|---|---|---|---|---|---|
| IMAGE IN INTERFACE | Z | A | A | A | A | A | A | A | B | B | B | B | B | B | B | B | B | B | B | B | B | B | B | B | B | B |
| IMAGE IN FRAME MEMORY | Z | Z | A | A | A | A | A | A | A | B | B | B | B | B | B | B | B | B | B | B | B | B | B | B | B | B |
| DISPLAY REFRESH | | | A | A | A | | A | A | A | B | B | B | | | B | B | B | | | | | | B | B | B | |
| DISPLAYED IMAGE | Z | Z | A | A | A | A | A | A | A | B | B | B | B | B | B | B | B | B | B | B | B | B | B | B | B | B |
| PIXEL VOLTAGE POLARITY | − | − | − | − | − | − | + | + | + | + | + | + | + | + | − | − | − | − | − | − | − | − | + | + | + | + |
| POLARITY BALANCE | 5 | 4 | 3 | 2 | 1 | 0 | 1 | 2 | 3 | 4 | 5 | 6 | 7 | 8 | 7 | 6 | 5 | 4 | 3 | 2 | 1 | 0 | 1 | 2 | 3 | 4 |

FIG. 10

| FRAME NUMBER | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
|---|---|---|---|---|---|---|---|---|---|---|---|---|---|---|---|---|---|---|---|---|---|---|---|---|---|
| IMAGE IN INTERFACE | | A | | | | | B | | | | | | | | | | | | | | | | | | |
| IMAGE IN FRAME MEMORY | Z | A | A | A | A | A | B | B | B | B | B | B | B | B | B | B | B | B | B | B | B | B | B | B | |
| DISPLAY REFRESH | | A | | | | | B | | | | | | B | | | | | | | | B | | | | |
| DISPLAYED IMAGE | Z | A | A | A | A | A | B | B | B | B | B | B | B | B | B | B | B | B | B | B | B | B | B | B | B |
| PIXEL VOLTAGE POLARITY | − | + | + | + | + | + | − | − | − | − | − | − | + | + | + | + | + | + | + | + | − | − | − | − | − |
| POLARITY BALANCE | 1 | 2 | 3 | 4 | 5 | 6 | 5 | 4 | 3 | 2 | 1 | 0 | 1 | 2 | 3 | 4 | 5 | 6 | 7 | 8 | 7 | 6 | 5 | 4 | 3 |

FIG. 12

| FRAME NUMBER | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
|---|---|---|---|---|---|---|---|---|---|---|---|---|---|---|---|---|---|---|---|---|---|---|---|---|---|
| IMAGE IN INTERFACE | Z | A | A | A | A | A | B | B | B | B | B | B | B | B | B | B | B | B | B | B | B | B | B | B | B |
| IMAGE IN FRAME MEMORY | Z | Z | A | A | A | A | A | B | B | B | B | B | B | B | B | B | B | B | B | B | B | B | B | B | B |
| DISPLAY REFRESH | | | A | | | | | B | | | | | | | | | | | | | | | | | |
| DISPLAYED IMAGE | Z | Z | A | A | A | A | A | B | B | B | B | B | B | B | B | B | B | B | B | B | B | B | B | B | B |
| PIXEL VOLTAGE POLARITY | − | − | + | + | + | + | + | − | − | − | − | − | − | − | − | − | − | − | − | − | − | − | − | − | − |
| POLARITY BALANCE | 2 | 1 | 2 | 3 | 4 | 5 | 6 | 5 | 4 | 3 | 2 | 1 | 0 | −1 | −2 | −3 | −4 | −5 | −6 | −7 | −8 | −9 | −10 | −11 | −12 |

DISPLAY DEVICE DRIVING METHOD, DISPLAY DEVICE, AND LIQUID CRYSTAL DISPLAY DEVICE

TECHNICAL FIELD

The present invention relates to a method of driving a display device, a display device, and a liquid crystal display device.

BACKGROUND ART

Conventionally, liquid crystal display devices have been mounted in a wide variety of electronic devices. Due to having advantages such as small thickness, light weight, and low power consumption, the liquid crystal display devices are expected to be utilized further in the future.

In recent years, a common object of various display devices has been to reduce electric power consumption. As one of effective techniques of attaining this object, pause driving has been suggested. After scanning a display panel in each frame in a scanning period, a display device which carries out the pause driving does not scan the display panel in each frame in a next pause period. In the pause period, voltages applied to respective pixels of the display panel in a previous frame are retained and, accordingly, display of an image is also maintained. This causes no scanning signal and no image signal to be supplied to the display panel in the pause period. Therefore, it is possible to correspondingly reduce electric power consumption.

Patent Literature 1 discloses an example of the display device which carried out the pause driving.

CITATION LIST

Patent Literature 1

Japanese Patent Application Publication, Tokukai No. 2002-182619 A (Publication Date: Jun. 26, 2002)

SUMMARY OF INVENTION

Technical Problem

As one of techniques of carrying out the pause driving, there is known a technique in which, in a case where an image corresponding to a previous frame is identical to that corresponding to a current frame, display of the image corresponding to the previous frame is maintained in the current frame or a frame which comes one (1) frame after the current frame, instead of being refreshed. Problems with this technique will be described below with reference to FIG. 12.

FIG. 12 is a timing diagram illustrating, in detail, how control is carried out in each frame while a display device is in operation. According to the display device which carries out control as illustrated in FIG. 12, a host supplies an image signal to a timing controller via an interface in each frame.

According to an example illustrated in FIG. 12, in the second frame, an image signal supplied to the timing controller via the inter face is different from that stored in a frame memory. Therefore, the timing controller writes, in the frame memory, the image signal received in the second frame. In the third frame, the display device carries out display refresh on a display panel with the use of the image signal stored in the frame memory. In this case, the image signal, having a polarity opposite to that of pixel applied voltages in the second frame, is supplied to the display panel. This causes, in the second frame, (i) a displayed image to be changed to an image "A" and (ii) the polarity of the pixel applied voltages to be changed from a negative (−) polarity to a positive (+) polarity. In the second frame, a polarity balance value of the pixel applied voltages is "2". This indicates that a polarity balance of the pixel applied voltages is biased, by two, to a positive (+) side.

After that, as long as frames continue in each of which an identical image signal is supplied to the timing controller, the display device does not carry out the display refresh on the display panel. That is, the pixel applied voltages have the positive (+) polarity without change. This causes the polarity balance value of the pixel applied voltages to increase by one for each frame.

According to the example illustrated in FIG. 12, in the seventh frame, an image signal supplied to the timing controller via the interface is different from that stored in the frame memory. Therefore, the timing controller writes, in the frame memory, the image signal received in the seventh frame. In the eighth frame, the display device carries out the display refresh on the display panel with the use of the image signal stored in the frame memory. In this case, the image signal, having a polarity opposite to that of the pixel applied voltages in the second frame, is supplied to the display panel. This causes, in the eighth frame, (i) the displayed image to be changed to an image "B" and (ii) the polarity of the pixel applied voltages to be changed from the positive (+) polarity to the negative (−) polarity. In the eighth frame, the polarity balance value of the pixel applied voltages is "5". This indicates that the polarity balance of the pixel applied voltages is biased, by five, to the positive (+) side.

In the ninth frame and each of frames after the ninth frame, an identical image signal continues to be supplied to the timing controller 8. Therefore, in the ninth frame and each of the frames after the ninth frame, the display device 1 does not carry out the display refresh on the display panel 2. As a result, the image "B" displayed in the eighth frame continues to be displayed as it is in the ninth frame and each of the frames after the ninth frame.

Meanwhile, in the ninth frame and each of the frames after the ninth frame, the pixel applied voltages have the negative (−) polarity without change. This causes the polarity balance value to continue to decrease by one for each frame. As a result, in the twenty-fifth frame, the polarity balance value decreases to "−12". This indicates that the polarity balance of the pixel applied voltages is significantly biased to a negative (−) side. In a case where there is no change in image signal supplied to the timing controller in each frame, the polarity balance of the pixel applied voltages is further biased to the negative (−) side.

As has been described, according to the display device in accordance with the conventional technique, the polarity of the pixel applied voltages tends to be significantly biased to the positive (+) or negative (−) side. Accordingly, each voltage applied to a corresponding liquid crystal also tends to be significantly biased to the positive (+) or negative (−) side. This results in a deterioration(s) in the liquid crystal and/or a TFT in the display panel. That is, according to the conventional technique, it is not possible to prevent a deterioration in the display panel 2, even though electric power consumption can be reduced.

The present invention has been made in view of the above problems and, according to a display device in accordance with an aspect of the present invention, it is possible to prevent a deterioration in a display panel while reducing electric power consumption.

Solution to Problem

In order to attain the above object, a method of driving a display device in accordance with an embodiment of the present invention is a method of driving a display device which includes a display panel having pixels and which is configured such that (i) a scanning signal and an image signal are supplied to the display panel in a scanning frame and (ii) no scanning signal and no image signal are supplied to the display panel in a pause frame, the method including:

supplying an image signal, having a polarity opposite to that of voltages applied to the respective pixels in a current frame, to the display panel in a next frame, in a case where a polarity balance value, indicative of a polarity balance of the pixels in the current frame, is equal to a predetermined reference value.

In order to attain the above object, a display device in accordance with an aspect of the present invention is a display device which includes a display panel having pixels and which is configured such that (i) a scanning signal and an image signal are supplied to the display panel in a scanning frame and (ii) no scanning signal and no image signal are supplied to the display panel in a pause frame, the display device further including:

a supplying section for supplying an image signal, having a polarity opposite to that of voltages applied to the respective pixels in a current frame, to the display panel in a next frame, in a case where a polarity balance value, indicative of a polarity balance of the pixels in the current frame, is equal to a predetermined reference value.

Additional objects, features, and strengths of the present invention will be made clear by the description below. Further, the advantages of the present invention will be evident from the following explanation in reference to the drawings.

Advantageous Effects of Invention

According to a display device in accordance with an aspect of the present invention, it is possible to prevent a deterioration in a display panel while reducing electric power consumption.

BRIEF DESCRIPTION OF DRAWINGS

FIG. 2 is a timing diagram illustrating, in detail, how control is carried out in each frame while the display device in accordance with Embodiment 1 of the present invention is in operation.

FIG. 6 is a timing diagram illustrating, in detail, how control is carried out in each frame while a display device in accordance with Embodiment 2 of the present invention is in operation.

FIG. 7 is a timing diagram illustrating, in detail, how control is carried out in each frame while a display device in accordance with Variation 1 of Embodiment 2 of the present invention is in operation.

FIG. 8 is a timing diagram illustrating, in detail, how control is carried out in each frame while a display device in accordance with Variation 2 of Embodiment 2 of the present invention is in operation.

FIG. 10 is a timing diagram illustrating, in detail, how control is carried out in each frame while a display device in accordance with Embodiment 4 of the present invention is in operation.

FIG. 12 is a timing diagram illustrating, in detail, how control is carried out in each frame while a display device in accordance with a conventional technique is in operation.

DESCRIPTION OF EMBODIMENTS

Embodiment 1

The following description will discuss Embodiment 1 of the present invention with reference to FIGS. 1 through 5.

(Display Device 1)

Figure 1:
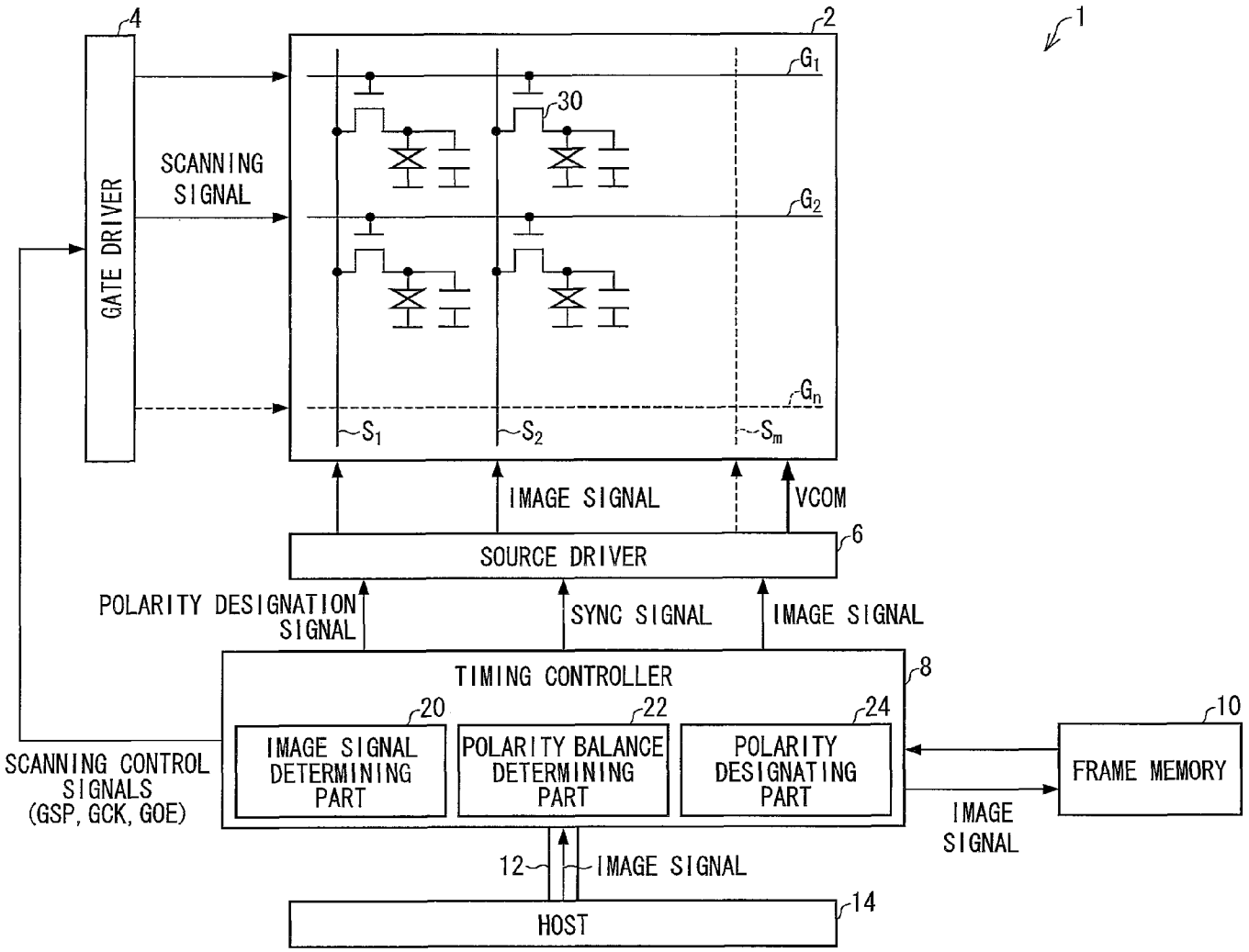
FIG. 1 is a block diagram illustrating a configuration of a main part of a display device in accordance with an embodiment of the present invention.

FIG. 1 is bock diagram illustrating, in detail, a configuration of a display device 1 in accordance with Embodiment 1. As illustrated in FIG. 1, the display device 1 includes a display panel 2, a gate driver 4 (driving section, output section), a source driver 6 (driving section), a timing controller 8 (writing section), a frame memory 10, an interface 12, and a host 14. The timing controller 8 includes an image signal determining part 20 (image signal determining section), a polarity balance determining part (calculating section, polarity balance determining section), and a polarity designating part 24.

The display panel 2 includes a screen having a plurality of pixels which are arranged in a matrix manner. The display panel 2 further includes N (N is any integer) scanning lines G (gate lines) via which the screen is to be selected line-sequentially so as to be scanned. The display panel 2 further includes M (M is any integer) data lines S (source lines) via which an image signal is supplied to pixels corresponding to a selected one of the scanning lines G.

The scanning lines G and the data lines S intersect with each other. The plurality of pixels are provided near respective intersections of the scanning lines G and the data lines S. Each of the plurality of pixels has (i) a TFT (Thin Film Transistor) 30 which serves as a switching element and (ii) a pixel electrode. In Embodiment 1, an n-channel TFT is employed as the TFT 30. The pixel electrode is connected to a drain of the TFT 30.

The display panel 2 further includes a liquid crystal layer (not illustrated), a common electrode (not illustrated), and an auxiliary electrode (not illustrated). The common electrode and the auxiliary electrode each face the pixel electrode via the liquid crystal layer. That is, the display device 1 is a so-called liquid crystal display device.

Note that G(n), illustrated in FIG. 1, indicates the n-th scanning line G, where n is an integer not less than 1 (one) and not more than N. For example, G(1), G(2), and G(3) indicate the first, second, and third scanning lines G, respectively. Note also that S(m) indicates the m-th data line S, where m is an integer not less than 1 (one) and not more than M. For example, S(1), S(2), and S(3) indicate the first, second, and third data lines S, respectively.

(Flow of Driving)

A basic flow of a process will be described below which process is carried out in a case where the display device 1 drives the display panel 2 so that an image is displayed.

First, the host 14 in the display device 1 supplies a sync signal and an image signal to the timing controller 8 via the interface 12. The timing controller 8 receives the sync signal and the image signal. Note that, in Embodiment 1, the host 14 supplies, in each frame, a sync signal and an image signal to the timing controller 8.

The host 14 supplies, to the timing controller 8, at least a clock signal, a horizontal sync signal, and a vertical sync signal, each of which serves as the sync signal. In synchronization with such sync signals, the timing controller 8 supplies, to each circuit, corresponding signals based on which the each circuit operates. Specifically, the timing controller 8 supplies, to the gate driver 4, various scanning control signals (a gate start pulse signal GSP, a gate clock signal GCK, and a gate output enable signal GOE). The timing controller 8 supplies, to the source driver 6, various sync signals (a source start pulse signal SSP, a source latch strobe signal SLS, and a source clock signal SCK).

The image signal is a signal indicative of an image corresponding to 1 (one) screen in a frame. According to the display device 1, the image signal is supplied to the timing controller 8 from the host 14, in a frame which comes one (1) frame before a frame in which the image signal is actually supplied to the display panel 2. The timing controller 8 temporarily stores, in the frame memory 10, the image signal thus received.

The frame memory 10 is a volatile memory such as an eDRAM. The frame memory 10 has at least a memory region for an image signal in which memory region an image signal corresponding to 1 (one) frame (1 (one) screen) is stored. In a case where the timing controller 8 writes a received image signal in the frame memory 10, the timing controller 8 writes the received image signal in the memory region for an image signal.

The timing controller 8 reads out, from the frame memory 10, an image signal stored in the frame memory 10, in a case where a frame, in which the image signal is necessitated, comes. The timing controller 8 supplies, to the source driver 6, the image signal thus read out.

The gate driver 4 starts scanning of the display panel 2 in synchronization with a gate start pulse signal GSP supplied from the timing controller 8. The gate driver 4 sequentially scans the scanning lines G from top to bottom on the screen of the display panel 2. While scanning the scanning lines G, the gate driver 4 sequentially supplies a corresponding scanning signal, which has a rectangular shape and which causes the TFT 30 to be turned on, to each of the scanning lines G in synchronization with a gate clock signal GCK, which is a signal for shifting a scanning line G to be selected. This causes pixels corresponding to 1 (one) row on the screen to be selected.

The source driver 6 calculates, based on an image signal supplied from the timing controller 8, voltages to be applied to respective pixels in a selected row, and then applies the voltages to the respective data lines S. This causes the image signal to be supplied to pixels (pixel electrodes) on a selected one of the scanning lines G. Based on a source start pulse signal SSP supplied from the timing controller 8, the source driver 6 stores in a register the image signal supplied to the pixels, in synchronization with a source clock signal SCK. After storing the image signal, the source driver 6 writes the image signal in the pixel electrodes of such selected pixels via the respective data lines S of the display panel 2, in response to a next source latch strobe signal SLS. An analog amplifier (not illustrated) of, for example, the source driver 6 is used to write the image signal.

According to the display device 1, a common electrode (not illustrated) and an auxiliary electrode (not illustrated) are further provided for each of the plurality of pixels on the screen. The source driver 6 applies a given common voltage (VCOM) to the common electrode.

A given voltage (liquid crystal applied voltage) is thus applied to a liquid crystal layer in each of the plurality of pixels, in accordance with the voltages of the image signal supplied to the plurality of pixels. In accordance with this liquid crystal applied voltage, transmittance of liquid crystal is controlled. As a result, corresponding backlight, whose amount varies depending on the transmittance, is outputted outside the display panel 2 through each of the plurality of pixels. This causes each of the plurality of pixels to display luminance which varies depending on the image signal supplied to the each of the plurality of pixels. Consequently, the display panel 2 displays, on the screen, an image which varies depending on the image signal.

The display device 1 carries out so-called pause driving (later described in detail). Specifically, a scanning signal and an image signal are supplied, in a scanning frame, to the display panel 2. In contrast, no scanning signal and no image signal are supplied, in a pause frame, to the display panel 2.

(Details of Drive Control)

FIG. 2 is a timing diagram illustrating, in detail, how control is carried out in each frame while the display device 1 in accordance with Embodiment 1 of the present invention is in operation. Note that, in a frame which comes one (1) frame before the first frame illustrated in FIG. 2, an image "Z" is displayed on the display panel 2. Note also that an image signal indicative of the image "Z" is stored in the frame memory 10. Note also that voltages to be applied to respective pixels (hereinafter, referred to as pixel applied voltages) have a negative (−) polarity.

(Polarity Balance Value)

According to the display device 1 of Embodiment 1, the polarity balance determining part 22 calculates, in each frame, a polarity balance value indicative of a polarity balance of pixel applied voltages. In a case where the pixel applied voltages have a positive (+) polarity, the polarity balance determining part 22 adds, in each frame, "1 (one)," which is a certain value, to the polarity balance value. On the other hand, in a case where the pixel applied voltages have a negative (−) polarity, the polarity balance determining part 22 subtracts "1 (one)," which is a certain value, from the polarity balance value. The display device 1 carries out a characteristic process depending on the polarity balance value so as to prevent a deterioration in quality of the display panel 2 (later described in detail). In Embodiment 1, the polarity balance value in a frame which comes one (1) frame before the first frame is "3."

(Process in First Frame)

In the first frame illustrated in FIG. 2, the host 14 supplies an image signal indicative of the image "Z" to the timing controller 8 via the interface 12. The image signal determining part 20 determines whether or not, in the first frame, the image signal thus supplied to the timing controller 8 matches the image signal stored in the frame memory 10. As described above, in the first frame, the image signal indicative of the image "Z" is stored in the frame memory 10.

Therefore, the image signal determining part 20 determines that, in the first frame, the image signal supplied to the timing controller 8 matches the image signal stored in the frame memory 10.

Such a determination causes the timing controller 8 not to write, in the frame memory 10, the image signal thus received. This ultimately causes (i) the image signal stored in the frame memory 10 not to be changed and (ii) the timing controller 8 not to drive the display panel 2. Specifically, the timing controller 8 supplies, to the gate driver 4, a control signal which instructs the gate driver 4 not to supply a scanning signal to the display panel 2. Meanwhile, the timing controller 8 does not supply any image signal to the source driver 6. As a result, in the first frame, the gate driver 4 does not supply a scanning signal to any of the scanning lines G, and the source driver 6 does not supply an image signal to any of the data lines S. Therefore, refresh of display on the display panel 2 is not carried out.

In the first frame, the voltages, applied to the respective plurality of pixels in the frame which comes one (1) frame before the first frame, continues to be applied, as they are, to the respective plurality of pixels. It follows that each voltage, applied to a corresponding liquid crystal of the display panel 2 in the frame before the first frame, is maintained as it is in the first frame. As a result, display of the image "Z" is maintained as it is in the first frame.

The pixel applied voltages in the first frame have a polarity identical to that of the pixel applied voltages in the frame which comes one (1) frame before the first frame. That is, the plurality of pixels have a negative (−) polarity in the first frame. The polarity balance determining part 22 accordingly subtracts "1 (one)", which is a certain value, from a current polarity balance value. This results in that the polarity balance value is "2" in the first frame.

The polarity balance determining part 22 determines whether or not the polarity balance value calculated in the first frame is equal to a predetermined reference value. Note, in Embodiment 1, that the predetermined reference value is "0 (zero)" or "8." Therefore, the polarity balance determining part 22 determines that the polarity balance value in the first frame is not equal to the predetermined reference value.

(Process in Second Frame)

The host 14 supplies, in the second frame illustrated in FIG. 2, an image signal indicative of an image "A" to the timing controller 8 via the interface 12. The image signal determining part 20 determines whether or not, in the second frame, the image signal thus supplied to the timing controller 8 matches the image signal stored in the frame memory 10. As a result, in the second frame, the image signal determining part 20 determines that the image signal supplied to the timing controller 8 does not match the image signal stored in the frame memory 10.

Such a determination causes the timing controller 8 to (i) delete the image signal, indicative of the image "Z", stored in the frame memory 10 and (ii) write, in the frame memory 10, the image signal supplied from the host 14. It follows that the image signal, indicative of the image "Z", stored in the frame memory 10 is replaced with the image signal indicative of the image "A". The timing controller 8 sets a driving period (first driving period) made up of at least one successive scanning frame, i.e., the third frame (which follows the second frame) only or the third frame and succeeding frame(s). In Embodiment 1, the first driving period is made up of one (1) scanning frame. In accordance with this setting, the display device 1 drives the display panel 2 in the third frame of the first driving period (later described in detail).

The display device 1 does not drive the display panel 2 in the second frame. This causes the refresh of the display on the display panel 2 not to be carried out. Consequently, in the second frame, the display of the image "Z" is maintained as it is, and the pixel applied voltages have the negative (−) polarity. The polarity balance determining part 22 accordingly subtracts "1 (one)" from the current polarity balance value. This results in that the polarity balance value is "1 (one)" in the second frame.

The polarity balance determining part 22 determines whether or not the polarity balance value thus calculated in the first frame is equal to the predetermined reference value. As a result, the polarity balance determining part 22 determines that the polarity balance value in the second frame is not equal to the predetermined reference value.

(Process in Third Frame)

The host 14 supplies, in the third frame illustrated in FIG. 2, an image signal indicative of the image "A" to the timing controller 8 via the interface 12. In the third frame, the image signal thus supplied to the timing controller 8 matches the image signal stored in the frame memory 10. Therefore, the image signal stored in the frame memory 10 is not changed.

As described above, the display device 1 is set so that the first driving period is made up of the third frame. Thus, the display device 1 drives the display panel 2 in the third frame. Specifically, the timing controller 8 supplies, to the gate driver 4, a control signal which instructs the gate driver 4 to supply a scanning signal to the display panel 2. Meanwhile, the timing controller 8 reads out, from the frame memory 10, the image signal indicative of the image "A," and then supplies the image signal thus read out to the source driver 6. Furthermore, the polarity designating part 24 in the timing controller 8 generates a polarity designation signal which designates a polarity of the image signal that is to be supplied to the display panel 2, and then supplies the polarity designation signal thus generated to the source driver 6. In doing so, the polarity designating part 24 generates a polarity designation signal which designates a polarity opposite to that of the pixel applied voltages in the second frame followed by the third frame. That is, in the third frame, the polarity designating part 24 supplies, to the source driver 6, a polarity designation signal which designates a positive (+) polarity.

The gate driver 4 sequentially supplies each scanning signal to a corresponding one of the scanning lines G in response to the control signal supplied from the timing controller 8. The source driver 6 determines the polarity of the image signal, to be supplied to the display panel 2, in accordance with the polarity designation signal supplied from the timing controller 8. The source driver 6 then supplies, to the data lines S, the image signal having the polarity thus determined. This causes the refresh of the display on the display panel 2 to be carried out in the third frame. As a result, an image displayed on the display panel 2 is changed from the image "Z" to the image "A".

The pixel applied voltages have, in the third frame, a polarity opposite to that of the pixel applied voltages in a frame which comes one (1) frame before the third frame. That is, the plurality of pixels have a positive (+) polarity in the third frame. The polarity balance determining part 22 accordingly adds "1 (one)" to the current polarity balance value. This results in that the polarity balance value is "2" in the third frame.

The polarity balance determining part 22 determines whether or not the polarity balance value thus calculated in the third frame is equal to the predetermined reference value. As a result, the polarity balance determining part 22 determines that the polarity balance value in the third frame is not equal to the predetermined reference value.

(Process in Each of Fourth Frame Through Sixth Frame)

An image signal, supplied to the timing controller 8 via the interface 12 in each of the fourth frame through the sixth frame illustrated in FIG. 2, is an image signal indicative of the image "A." That is, in each of the fourth frame through the sixth frame, the image signal supplied to the timing controller 8 matches the image signal stored in the frame memory 10. Therefore, the pixel applied voltages in the third frame are maintained as they are in each of the fourth frame through the sixth frame. This causes display refresh on the display panel 2 not to be carried out. It follows that a displayed image "A" remains unchanged.

In each of the fourth frame through the sixth frame, the pixel applied voltages have a positive (+) polarity without change. Therefore, the polarity balance value increases by one in each of the fourth frame through the sixth frame. This results in that the polarity balance value is "5" in the sixth frame. Note that, in each of the fourth frame through the sixth frame, the polarity balance determining part 22 determines that the polarity balance value is not equal to the predetermined reference value.

(Process in Seventh Frame)

The host 14 supplies, in the seventh frame illustrated in FIG. 2, an image signal indicative of an image "B" to the timing controller 8 via the interface 12. The image signal determining part 20 determines whether or not, in the second frame, the image signal thus supplied to the timing controller 8 matches the image signal stored in the frame memory 10. As a result, in the second frame, the image signal determining part 20 determines that the image signal supplied to the timing controller 8 does not match the image signal stored in the frame memory 10.

Such a determination causes the timing controller 8 to (i) delete the image signal, indicative of the image "A", stored in the frame memory 10 and (ii) write, in the frame memory 10, the image signal supplied from the host 14. It follows that the image signal, indicative of the image "A", stored in the frame memory 10 is replaced with the image signal indicative of the image "B". The timing controller 8 sets a driving period (first driving period) made up of at least one successive frame, i.e., the eighth frame (which follows the seventh frame) only or the eighth frame and succeeding frame(s). In Embodiment 1, the first driving period is made up of one scanning frame. In accordance with this setting, the display device 1 drives the display panel 2 in the eighth frame in the driving period (later described in detail).

The display device 1 does not drive the display panel 2 in the seventh frame. This causes the refresh of the display on the display panel 2 not to be carried out. Consequently, in the seventh frame, display of the image "A" is maintained as it is, and the pixel applied voltages have the positive (+) polarity. The polarity balance determining part 22 accordingly adds "1 (one)" to the current polarity balance value. This results in that the polarity balance value is "6" in the seventh frame.

The polarity balance determining part 22 determines whether or not the polarity balance value thus calculated in the seventh frame is equal to the predetermined reference value. As a result, the polarity balance determining part 22 determines that the polarity balance value in the seventh frame is not equal to the predetermined reference value.

(Process in Eighth Frame)

The host 14 supplies, in the eighth frame illustrated in FIG. 2, an image signal indicative of the image "B" to the timing controller 8 via the interface 12. In the eighth frame, the image signal thus supplied to the timing controller 8 matches the image signal stored in the frame memory 10. Therefore, the image signal stored in the frame memory 10 is not changed.

As has been described, the display device 1 is set so that the first driving period is made up of the eighth frame. Thus, the display device 1 drives the display panel 2 in the eighth frame. Specifically, the timing controller 8 supplies, to the gate driver 4, a control signal which instructs the gate driver 4 to supply a scanning signal to the display panel 2. Meanwhile, the timing controller 8 reads out, from the frame memory 10, the image signal indicative of the image "B," and supplies the image signal thus read out to the source driver 6. Furthermore, the polarity designating part 24 in the timing controller 8 generates a polarity designation signal which designates a polarity of the image signal that is to be supplied to the display panel 2, and then supplies the polarity designation signal thus generated to the source driver 6. In doing so, the polarity designating part 24 generates a polarity designation signal which designates a polarity opposite to that of the pixel applied voltages in the seventh frame followed by the eighth frame. That is, in the eighth frame, the polarity designating part 24 supplies, to the source driver 6, a polarity designation signal which designates a negative (−) polarity.

The gate driver 4 sequentially supplies each scanning signal to a corresponding one of the scanning lines G in response to the control signal supplied from the timing controller 8. The source driver 6 determines the polarity of the image signal, to be supplied to the display panel 2, in accordance with the polarity designation signal supplied from the timing controller 8. The source driver 6 then supplies, to the data lines S, the image signal having the polarity thus determined. This causes the refresh of the display on the display panel 2 to be carried out in the third frame. As a result, the image displayed on the display panel 2 is changed from the image "Z" to the image "A".

The pixel applied voltages have, in the eighth frame, a polarity opposite to that of the pixel applied voltages in a frame which comes one (1) frame before the eighth frame. That is, the plurality of pixels have the negative (−) polarity in the eighth frame. The polarity balance determining part 22 accordingly subtracts "1 (one)" from the current polarity balance value. This results in that the polarity balance value is "5" in the eighth frame.

The polarity balance determining part 22 determines whether or not the polarity balance value thus calculated in the eighth frame is equal to the predetermined reference value. As a result, the polarity balance determining part 22 determines that the polarity balance value in the eighth frame is not equal to the predetermined reference value.

(Process in Each of Ninth Frame Through Twelfth Frame)

An image signal supplied to the timing controller 8 via the interface 12 in each of the ninth frame through the twelfth frame illustrated in FIG. 2 is an image signal indicative of the image "B". That is, in each of the ninth frame through the twelfth frame, the image signal supplied to the timing controller 8 matches the image signal stored in the frame memory 10. Therefore, the pixel applied voltages in the eighth frame are maintained as they are in each of the ninth frame through the twelfth frame. This causes the display refresh on the display panel 2 not to be carried out. It follows that a displayed image "B" remains unchanged.

In each of the ninth frame through the twelfth frame, the pixel applied voltages have the negative (−) polarity without change. Therefore, the polarity balance value decreases by one in each of the ninth frame through the twelfth frame.

This results in that the polarity balance value is "1 (one)" in the twelfth frame. Note that, in each of the ninth frame through the twelfth frame, the polarity balance determining part 22 determines that the polarity balance value is not equal to the predetermined reference value.

(Process in Thirteenth Frame)

An image signal supplied to the timing controller 8 via the interface 12 in the thirteenth frame illustrated in FIG. 2 is an image signal indicative of the image "B". That is, in the thirteenth frame, the image signal thus supplied to the timing controller 8 matches the image signal stored in the frame memory 10. Therefore, the pixel applied voltages in the eighth frame are maintained as they are in the thirteenth frame. This causes the display refresh on the display panel 2 not to be carried out. It follows that the displayed image "B" remains unchanged.

In the thirteenth frame, the pixel applied voltages have the negative (−) polarity without change. This results in that the polarity balance value is "0 (zero)" in the thirteenth frame. The polarity balance determining part 22 therefore determines that the polarity balance value in the thirteenth frame is equal to the predetermined reference value. The timing controller 8 then sets a driving period (second driving period) made up of at least one successive frame, i.e., the fourteenth frame (which follows the thirteenth frame) only or the fourteenth frame and succeeding frame(s). In Embodiment 1, the second driving period is made up of one scanning frame. In accordance with this setting, the display device 1 drives the display panel 2 in the fourteenth frame in the second driving period (later described in detail).

(Process in Fourteenth Frame)

The host 14 supplies, in the fourteenth frame illustrated in FIG. 2, an image signal indicative of the image "B" to the timing controller 8 via the interface 12. In the fourteenth frame, the image signal thus supplied to the timing controller 8 matches the image signal stored in the frame memory 10. Therefore, the image signal stored in the frame memory 10 is not changed.

As has been described, the display device 1 is set so that the second driving period is made up of the fourteenth frame. Thus, the display device 1 drives the display panel 2 in the fourteenth frame. Specifically, the timing controller 8 supplies, to the gate driver 4, a control signal which instructs the gate driver 4 to supply a scanning signal to the display panel 2. Meanwhile, the timing controller 8 reads out, from the frame memory 10, the image signal indicative of the image "B," and then supplies the image signal thus read out to the source driver 6. Note that the timing controller 8 can alternatively supply, to the source driver 6, the image signal received from the host 14 instead of the image signal stored in the frame memory 10.

Furthermore, the polarity designating part 24 in the timing controller 8 generates a polarity designation signal which designates the polarity of the image signal that is to be supplied to the display panel 2, and then supplies the polarity designation signal thus generated to the source driver 6. In doing so, the polarity designating part 24 generates a polarity designation signal which designates a polarity opposite to that of the pixel applied voltages in the thirteenth frame followed by the fourteenth frame. That is, in the fourteenth frame, the polarity designating part 24 supplies, to the source driver 6, a polarity designation signal which designates a positive polarity (+).

The gate driver 4 sequentially supplies each scanning signal to a corresponding one of the scanning lines G in response to the control signal supplied from the timing controller 8. The source driver 6 determines the polarity of the image signal, to be supplied to the display panel 2, in accordance with the polarity designation signal supplied from the timing controller 8. The source driver 6 then supplies, to the data lines S, the image signal having the polarity thus determined. This causes the refresh of the display on the display panel 2 to be carried out in the fourteenth frame. However, the displayed image "B" remains unchanged.

The pixel applied voltages have, in the fourteenth frame, a polarity opposite to that of the pixel applied voltages in a frame which comes one (1) frame before the fourteenth frame. That is, the plurality of pixels have the positive (+) polarity in the fourteenth frame. The polarity balance determining part 22 accordingly adds "1 (one)" to the current polarity balance value. This results in that the polarity balance value is "1 (one)" in the fourteenth frame.

The polarity balance determining part 22 determines whether or not the polarity balance value thus calculated in the fourteenth frame is equal to the predetermined reference value. As a result, the polarity balance determining part 22 determines that the polarity balance value in the fourteenth frame is not equal to the predetermined reference value.

(Process in Each of Fifteenth Frame Through Twentieth Frame)

An image signal, supplied to the timing controller 8 via the interface 12 in each of the fifteenth frame through the twentieth frame illustrated in FIG. 2, is an image signal indicative of the image "B." That is, in each of the fifteenth frame through the twentieth frame, the image signal supplied to the timing controller 8 matches the image signal stored in the frame memory 10. Therefore, the pixel applied voltages in the thirteenth frame are maintained as they are in each of the fifteenth frame through the twentieth frame. This causes the display refresh on the display panel 2 not to be carried out. It follows that the displayed image "B" remains unchanged.

In each of the fifteenth frame through the twentieth frame, the pixel applied voltages have the positive (+) polarity without change. Therefore, the polarity balance value increases by one in each of the fifteenth frame through the twentieth frame. This results in that the polarity balance value is "7" in the twentieth frame. Note that, in each of the fifteenth frame through the twentieth frame, the polarity balance determining part 22 determines that the polarity balance value is not equal to the predetermined reference value.

(Process in Twenty-First Frame)

An image signal, supplied to the timing controller 8 via the interface 12 in the twenty-first frame illustrated in FIG. 2, is an image signal indicative of the image "B." That is, in the twenty-first frame, the image signal supplied to the timing controller 8 matches the image signal stored in the frame memory 10. Therefore, the pixel applied voltages in the eighth frame are maintained as they are in the twenty-first frame. This causes the display refresh on the display panel 2 not to be carried out. It follows that the displayed image "B" remains unchanged.

In the twenty-first frame, the pixel applied voltages have the positive (+) polarity without change. This results in that the polarity balance value is "8" in the twenty-first frame. The polarity balance determining part 22 therefore determines that the polarity balance value in the twenty-first frame is equal to the predetermined reference value. The timing controller 8 then sets a driving period (second driving period) made up of at least one successive frame, i.e., the twenty-first frame (which follows the twentieth frame) only or the twenty-first frame and succeeding frame(s). In Embodiment 1, the second driving period is made up of one scanning frame. In accordance with this setting, the display device 1 drives the display panel 2 in the twenty-second frame in the second driving period (later described in detail).

(Process in Twenty-Second Frame)

The host 14 supplies, in the twenty-second frame illustrated in FIG. 2, an image signal indicative of the image "B" to the timing controller 8 via the interface 12. The image signal determining part 20 determines whether or not, in the twenty-second frame, the image signal thus supplied to the timing controller 8 matches the image signal stored in the frame memory 10. As a result, in the twenty-second frame, the image signal determining part 20 determines that the image signal supplied to the timing controller 8 matches the image signal stored in the frame memory 10. Such a determination causes the timing controller 8 not to write, in the frame memory 10, the image signal thus received. This ultimately causes the image signal stored in the frame memory 10 not to be changed.

As described above, the display device 1 is set so that the second driving period is made up of the twenty-second frame. Thus, the display device 1 drives the display panel 2 in the twenty-second frame. Specifically, the timing controller 8 supplies, to the gate driver 4, a control signal which instructs the gate driver 4 to supply a scanning signal to the display panel 2. Meanwhile, the timing controller 8 reads out, from the frame memory 10, the image signal indicative of the image "B," and then supplies the image signal to the source driver 6. Furthermore, the polarity designating part 24 in the timing controller 8 generates a polarity designation signal which designates the polarity of the image signal that is to be supplied to the display panel 2, and then supplies the polarity designation signal thus generated to the source driver 6. In doing so, the polarity designating part 24 generates a polarity designation signal which designates a polarity opposite to that of the pixel applied voltages in the twenty-first frame followed by the twenty-second frame. That is, in the twenty-second frame, the polarity designating part 24 supplies, to the source driver 6, a polarity designation signal which designates a negative polarity (−).

The gate driver 4 sequentially supplies each scanning signal to a corresponding one of the scanning lines G in response to the control signal supplied from the timing controller 8. The source driver 6 determines the polarity of the image signal, to be supplied to the display panel 2, in accordance with the polarity designation signal supplied from the timing controller 8. The source driver 6 then supplies, to the data lines S, the image signal having the polarity thus determined. This causes the refresh of the display on the display panel 2 to be carried out in the twenty-second frame. However, the displayed image "B" remains unchanged.

In the twenty-second frame, the pixel applied voltages have a polarity opposite to that of the pixel applied voltages in a frame which comes one (1) frame before the twenty-second frame. That is, the plurality of pixels have the negative (−) polarity in the twenty-second frame. The polarity balance determining part 22 accordingly subtracts "1 (one)" from the current polarity balance value. This results in that the polarity balance value is "7" in the twenty-second frame.

The polarity balance determining part 22 determines whether or not the polarity balance value thus calculated in the twenty-second frame is equal to the predetermined reference value. As a result, the polarity balance determining part 22 determines that the polarity balance value in the twenty-first frame is not equal to the predetermined reference value.

(Process in Each of Twenty-Third Frame Through Twenty-Fifth Frame)

An image signal, supplied to the timing controller 8 via the interface 12 in each of the twenty-third frame through the twenty-fifth frame illustrated in FIG. 2, is an image signal indicative of the image "B." That is, in each of the twenty-third frame through the twenty-fifth frame, the image signal supplied to the timing controller 8 matches the image signal stored in the frame memory 10. Therefore, the pixel applied voltages in the twenty-second frame is maintained as they are each of the twenty-third frame through the twenty-fifth frame. This causes the display refresh on the display panel 2 not to be carried out. It follows that the displayed image "B" remains unchanged.

In each of the twenty-third frame through the twenty-fifth frame, the pixel applied voltages have the negative (−) polarity without change. Therefore, the polarity balance value decreases by one in each of the twenty-third frame through the twenty-fifth frame. This results in that the polarity balance value is "4" in the twenty-fifth frame. Note that, in each of the twenty-third frame through the twenty-fifth frame, the polarity balance determining part 22 determines that the polarity balance value is not equal to the predetermined reference value.

(Operation and Effects)

According to the display device 1 of Embodiment 1, a first driving period is set, as has been described, in a case where an image signal corresponding to a current frame does not match that corresponding to a previous frame. Note here that the "previous frame" means a frame which comes one (1) frame before the current frame. In a case where (i) the image signal corresponding to the current frame matches that corresponding to the previous frame and (ii) a polarity balance value is equal to a reference value, the display device 1 sets a second driving period. The display panel 2 is driven merely in the first or second driving period. In a frame which is not included in any of the first and second driving periods, the display panel 2 is not driven. That is, an image displayed in the first or second driving period continues to be displayed as it is. Therefore, according to the display device 1 in accordance with Embodiment 1, it is possible to reduce electric power consumption, as compared with the conventional technique in which a display panel is absolutely driven in each frame.

Further, according to the display device 1, in a case where the polarity balance value in the current frame is equal to the reference value, pixel applied voltages have a reversed polarity in a next frame. Note here that the "next frame" means a frame which comes one (1) frame after the current frame. According to the display device 1, even in a case where pause frames continue for a long time period, the pixel applied voltages have a polarity which does not continue to be biased to positive or negative. Therefore, it is possible to maintain, within a given range (in Embodiment 1, range from 0 (zero) to 8), a polarity balance of the pixel applied voltages.

Furthermore, in the first frame of the first driving period, the image signal, having a polarity opposite to that of the pixel applied voltages in a frame which comes one (1) frame before the first frame in the first driving period, is supplied to the display panel 2. This causes (i) a displayed image to be switched to another and (ii) the pixel applied voltages have a reversed polarity. Therefore, it is possible to prevent the pixel applied voltages from having a polarity which is extremely biased to positive (+) or negative (−). In other words, it is possible to maintain, within the given range (in Embodiment 1, range from 0 (zero) to 8), the polarity balance of the pixel applied voltages.

Moreover, in the first frame of the second driving period, the image signal, having the polarity opposite to that of the pixel applied voltages in a frame which comes one (1) frame before the first frame in the second driving period, is supplied to the display panel 2. This causes (i) an identical image to continue to be displayed and (ii) the pixel applied voltages to have a reversed polarity. Therefore, it is possible to prevent the pixel applied voltages from having a polarity which is extremely biased to positive (+) or negative (−). In other words, it is possible to maintain, within the given range (in Embodiment 1, range from 0 (zero) to 8), the polarity balance of the pixel applied voltages.

As has been described, according to the display device 1 in accordance with Embodiment 1, each voltage, applied to a corresponding liquid crystal in the display panel 2, also is not extremely biased to positive (+) or negative (−). This makes it possible to prevent a deterioration(s) in the liquid crystal and/or the TFT 30 in the display panel 2. As a result, according to the display device 1 in accordance with Embodiment 1, it is possible to prevent a deterioration in the display panel 2 while reducing electric power consumption. Accordingly, a quality of the displayed image will never be deteriorated.

(Storage of Image Signal)

The display device 1 in accordance with Embodiment 1 can be alternatively arranged such that, in a current frame, an image signal supplied to the timing controller 8 is absolutely stored in the frame memory 10. In this case, regardless of whether the image signal supplied to the timing controller 8 matches or does not match that stored in the frame memory 10 in the current frame, the image signal supplied to the timing controller 8 is absolutely stored in the frame memory 10.

[Variation 1]

The following description will discuss Variation 1 of Embodiment 1. Configurations in Variation 1 which are identical to those in Embodiment 1 will not be described in detail.

Figure 3:
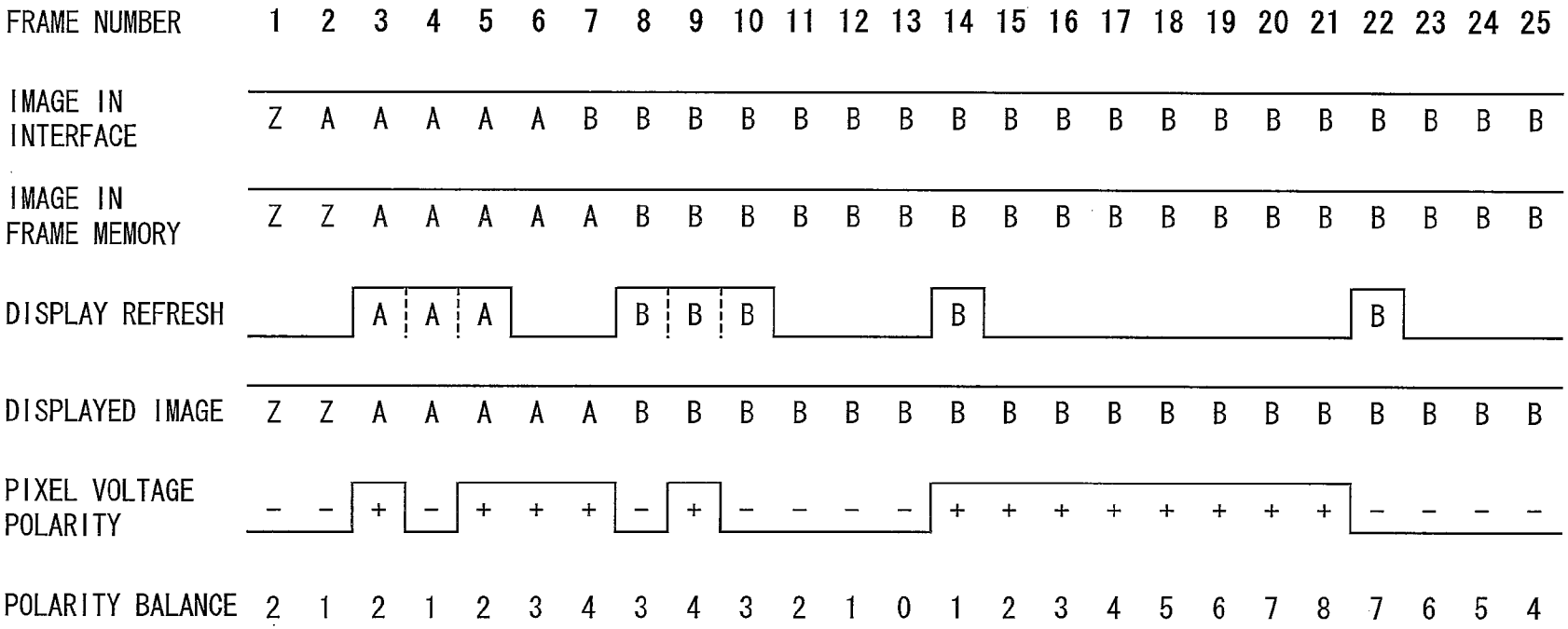
FIG. 3 is a timing diagram illustrating, in detail, how control is carried out in each frame while a display device in accordance with Variation 1 of Embodiment 1 of the present invention is in operation.

FIG. 3 is a second timing diagram illustrating, in detail, how control is carried out in each frame while a display device 1 in accordance with Variation 1 of Embodiment 1 of the present invention is in operation. According to an example illustrated in FIG. 3, a first driving period is made up of a plurality of frames. Specifically, a first driving period, in which an image "A" is displayed, is made up of the third frame through the fifth frame. Meanwhile, a first driving period, in which an image "B" is displayed, is made up of the eighth frame through the tenth frame.

Processes, carried out in the first frame through the third frame in Variation 1, are basically identical to those carried out in the first frame through the third frame in Embodiment 1. Note, however, a timing controller 8 sets, in the second frame, the first driving period made up of three successive scanning frames, i.e., the third frame (which follows the second frame) and succeeding frames. This causes a display panel 2 to be driven not only in the third frame but also in the fourth and fifth frames.

The display device 1 is configured such that an image signal, to be supplied to the display panel 2, has a polarity which is reversed for each frame in the first driving period in which the image "A" is displayed. Specifically, in the fourth frame, the image signal, having a negative (−) polarity, is supplied to the display panel 2. In the fifth frame, the image signal, having a positive (+) polarity, is supplied to the display panel 2. Note that, in the first frame, although the image signal supplied to the display panel 2 varies in polarity, the image signal does not vary in the image signal being an image signal indicative of the image "A." Therefore, the image "A," displayed on the display panel 2, remains unchanged in each of the third frame through the fifth frame.

Meanwhile, pixel applied voltages have a polarity which is reversed for each of the third frame through the fifth frame. Therefore, a polarity balance value increases or decreases by one for each frame. In Variation 1, the polarity balance value changes from "2" to "2," through "1 (one)," as the frame is changed from the third frame to the fifth frame, through the fourth frame.

Processes carried out in the sixth frame through the eighth frame in Variation 1 are basically identical to those carried out in the sixth frame and the seventh frame in Embodiment 1. Note, however, that the timing controller 8 sets, in the seventh frame, a driving period made up of three successive frames, i.e., the eighth frame (which follows the seventh frame) and succeeding frames. This causes the display panel 2 to be driven not only in the eighth frame but also in the ninth and tenth frames.

The display device 1 is configured such that an image signal, to be supplied to the display panel 2, has a polarity which is reversed for each frame in the first driving period in which the image "B" is displayed. Specifically, in the eighth frame, the image signal, having a negative (−) polarity, is supplied to the display panel 2. In the ninth frame, the image signal, having a positive (+) polarity, is supplied to the display panel 2. In the tenth frame, the image signal, having the negative (−) polarity, is supplied to the display panel 2. In the eighth frame through the tenth frame, although the image signal supplied to the display panel 2 varies in polarity, the image signal does not vary in the image signal being an image signal indicative of the image "A." Therefore, the image "A," displayed on the display panel 2, remains unchanged in each of the eighth frame through the tenth frame. Meanwhile, the pixel applied voltages have a polarity which is reversed for each of the eighth frame through the tenth frame. Therefore, the polarity balance value increases or decreases by one for each frame. In Variation 1, the polarity balance value changes from "3" to "3," through "4," as the frame is changed from the eighth frame to the tenth frame, through the ninth frame.

Note that processes carried out in the eleventh frame through the twenty-fifth frame are completely identical to those carried out in the eleventh frame through the twenty-fifth frame in Embodiment 1.

(Operation and Effects)

In Variation 1, similar to Embodiment 1, it is thus possible to prevent a deterioration in the display panel 2 while reducing electric power consumption. Therefore, a quality of a displayed image will never be deteriorated. In addition, in Variation 1, a first driving period is made up of a plurality of successive frames. That is, in the first driving period, one and the same image is continuously displayed over the plurality of successive frames. This makes it possible to prevent occurrence of an afterimage of the displayed image. Moreover, in Variation 1, pixel applied voltages have a polarity which is reversed for each frame in the first driving period. This makes it possible to further prevent a deterioration in the display panel.

[Variation 2]

The following description will discuss Variation 2 of Embodiment 1. Configurations in Variation 2 which are identical to those in Variation 1 will not be described in detail.

Figure 4:
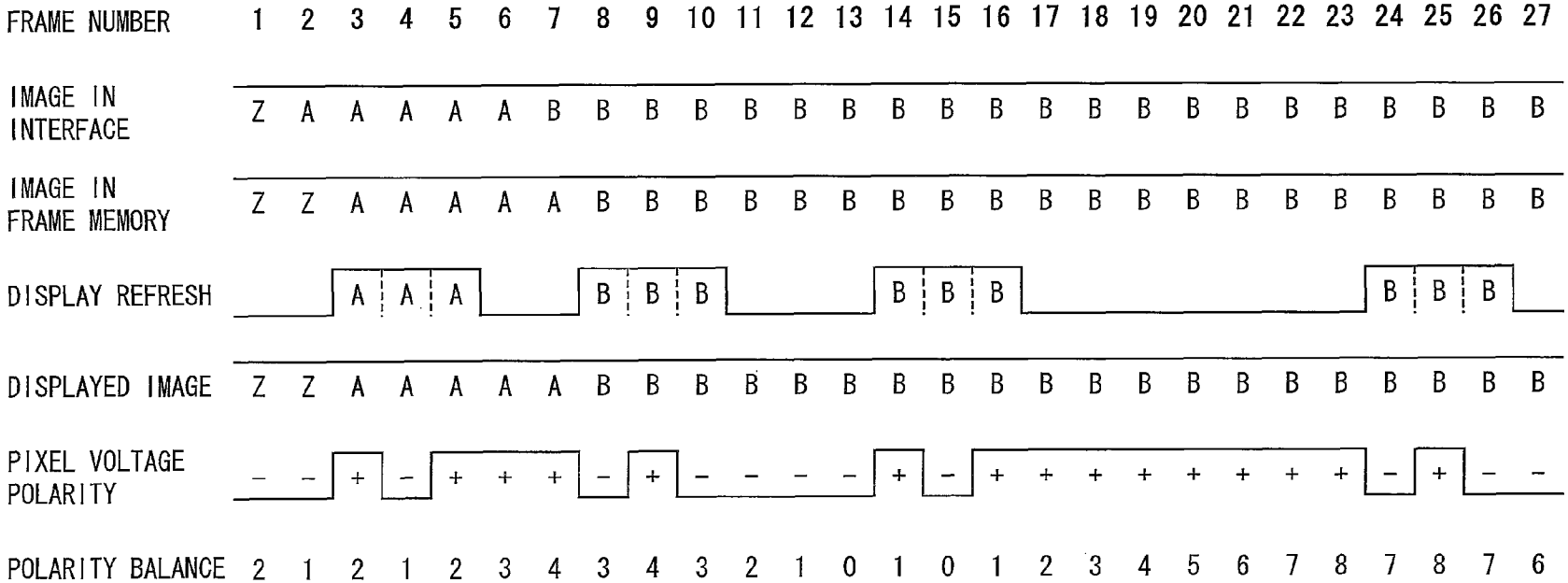
FIG. 4 is a timing diagram illustrating, in detail, how control is carried out in each frame while a display device in accordance with Variation 2 of Embodiment 1 of the present invention is in operation.

FIG. 4 is a timing diagram illustrating, in detail, how control is carried out in each frame while a display device 1 in accordance with Variation 2 of Embodiment 1 of the present invention is in operation. According to an example illustrated in FIG. 4, a first driving period is made up of a plurality of frames. Specifically, a first driving period, in which an image "A" is displayed, is made up of the third frame through the fifth frame. Meanwhile, a first driving period, in which an image "B" is displayed, is made up of the eighth frame through the tenth frame.

A second driving period is made up of a plurality of frames. Specifically, a second driving period, in which an image "B" is displayed, is made up of the fourteenth frame through the sixteenth frame. Meanwhile, another second driving period, in which the image "B" is displayed, is made up of the twenty-fourth frame through the twenty-sixth frame.

Processes carried out in the first frame through the fourteenth frame in Variation 2 are basically identical to those carried out in the first frame through the thirteenth frame in Variation 1. Note, however, that a timing controller 8 sets, in the fourteenth frame, the second driving period made up of three successive scanning frames, i.e., the fifteenth frame (which follows the fourteenth frame) and succeeding frames. This causes a display panel 2 to be driven not only in the fourteenth frame but also in the fifteenth and sixteenth frames.

The display device 1 is configured such that an image signal, to be supplied to the display panel 2, has a polarity which is reversed for each frame in the second driving period in which the image "B" is displayed. Specifically, in the fourteenth frame, the image signal, having a positive (+) polarity, is supplied to the display panel 2. In the fifteenth frame, the image signal, having a negative (−) polarity, is supplied to the display panel 2. In the sixteenth frame, the image signal, having the positive (+) polarity, is supplied to the display panel 2.

Note that, in the second driving period, although the image signal supplied to the display panel 2 varies in polarity, the image signal does not vary in the image signal being an image signal indicative of the image "B". Therefore, the image "B," displayed on the display panel 2, remains unchanged in each of the fourteenth frame through the sixteenth frame.

Meanwhile, pixel applied voltages have a polarity which is reversed for each of the fourteenth frame through the sixteenth frame. Therefore, a polarity balance value increases or decreases by one for each frame. In Variation 2, the polarity balance value changes from "1 (one)" to "1 (one)," through "0 (zero)," as the frame is changed from the fourteenth frame to the sixteenth frame, through the fifteenth frame.

Processes carried out in the seventeenth frame through the twenty-third frame in Variation 2 are basically identical to those carried out in the fifteenth frame to the twenty-first frame in Embodiment 1. Note, however, that the timing controller 8 sets, in the twenty-third frame, the another second driving period made up of three successive frames, i.e., the twenty-fourth frame (which follows the twenty-third frame) and succeeding frames. This causes the display panel 2 to be driven not only in the twenty-fourth frame but also in the twenty-fifth and twenty-sixth frames.

The display device 1 is also configured such that the image signal, to be supplied to the display panel 2, has a polarity which is reversed for each frame in the another second driving period in which the image "B" is displayed. Specifically, in the twenty-fourth frame, the image signal, having the negative (−) polarity, is supplied to the display panel 2. In the twenty-fifth frame, the image signal, having the positive (+) polarity, is supplied to the display panel 2. In the twenty-sixth frame, the image signal, having the negative (−) polarity, is supplied to the display panel 2.

Note, however, that, in the second driving period, although the image signal supplied to the display panel 2 varies in polarity, the image signal does not vary in the image signal being an image signal indicative of the image "B". Therefore, the image "B," displayed on the display panel 2, remains unchanged in each of the twenty-fourth frame through the sixteenth frame.

Meanwhile, the pixel applied voltages have a polarity which is reversed for each of the twenty-fourth frame through the twenty-sixth frame. Therefore, the polarity balance value increases or decreases by one for each frame. In Variation 2, the polarity balance value changes from "7" to "7," through "8," as the frame is changed from the twenty-fourth frame to twenty-sixth frame, through the twenty-fifth frame.

(Operation and Effects)

In Variation 2, similar to Variation 1, it is thus possible to prevent a deterioration in the display panel 2 while reducing electric power consumption. Therefore, a quality of a displayed image will never be deteriorated. Furthermore, in a first driving period, it is possible to prevent occurrence of an afterimage of the displayed image. In addition, in the Variation 2, a second driving period is made up of a plurality of successive frames. That is, in the second driving period, one and the same image is continuously displayed over the plurality of successive frames. This makes it possible to prevent occurrence of an afterimage of an image displayed in the second driving period. Moreover, in Variation 2, pixel applied voltages have a polarity which is reversed for each frame in the first and second driving periods. This makes it possible to further prevent a deterioration in the display panel.

[Variation 3]

The following description will discuss Variation 3 of Embodiment 1. Configurations in Variation 3 which are identical to those in Variation 2 will not be described in detail.

Figure 5:
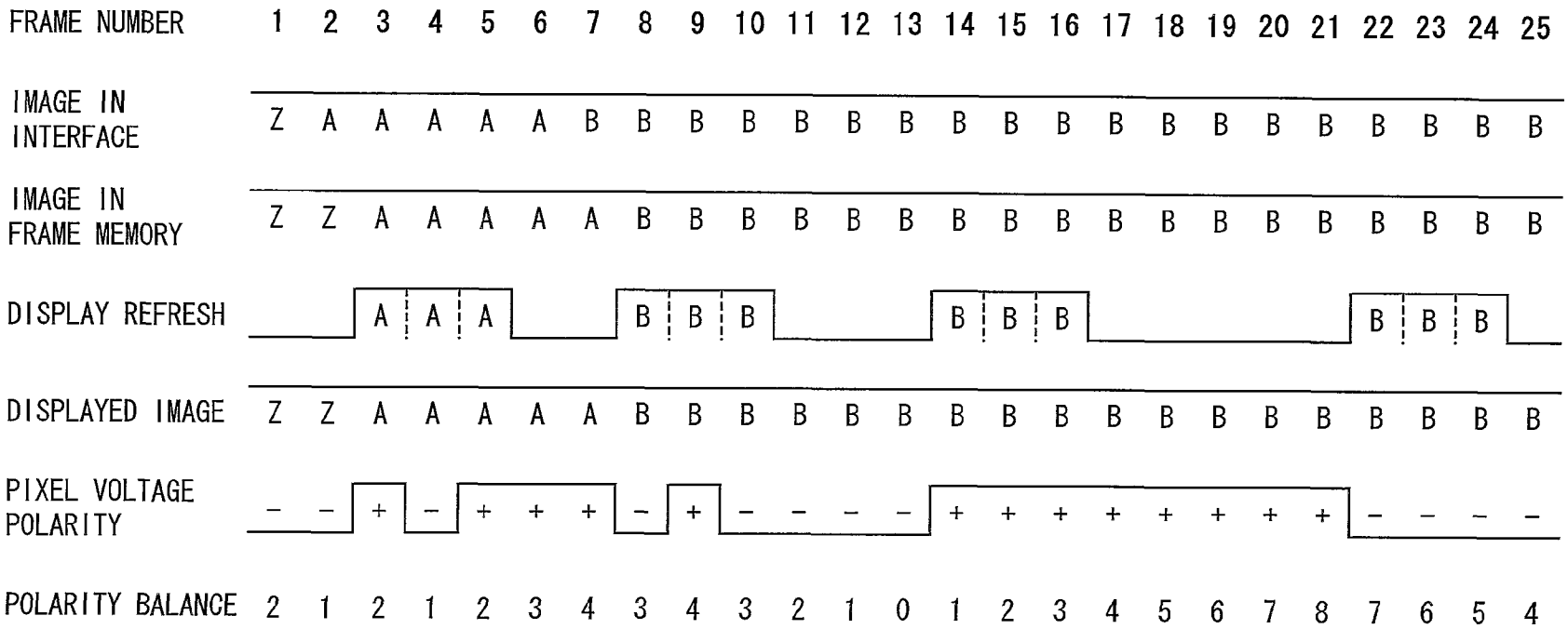
FIG. 5 is a timing diagram illustrating, in detail, how control is carried out in each frame while a display device in accordance with Variation 3 of Embodiment 1 of the present invention is in operation.

FIG. 5 is a timing diagram illustrating, in detail, how control is carried out in each frame while a display device 1 in accordance with Variation 3 of Embodiment 1 of the present invention is in operation. Variation 3 is different from Variation 2 in that an image signal, having an identical polarity, is supplied to a display panel 2 in each frame which makes up a second driving period. In regard to the other points, Variation 3 is basically identical to Variation 2.

According to an example illustrated in FIG. 5, a second driving period, in which an image "B" is displayed, is made up of the fourteenth frame through the sixteenth frame. Another second driving period, in which the image "B" is displayed, is made up of the twenty-second frame through the twenty-fourth frame.

In Variation 3, the source driver 6 supplies an image signal, having an identical polarity, to the display panel 2 in each of the fourteenth frame through the sixteenth frame which make up the second driving period. Specifically, since pixel applied voltages have a negative (−) polarity in the thirteenth frame, the image signal, having a positive (+)

polarity and indicating the image "B", is supplied to the display panel 2 in each of the fourteenth frame through the sixteenth frame.

The source driver 6 supplies the image signal, having an identical polarity, to the display panel 2 in each of the twenty-second frame and the twenty-third frame, which make up the another second driving period. Specifically, the pixel applied voltages have a positive (+) polarity in the twenty-first frame. Therefore, in each of the twenty-second frame through the twenty-fourth frame, the source driver 6 supplies the image signal, having a negative (−) polarity and indicating the image "B", to the display panel 2.

(Operation and Effects)

In Variation 3, similar to Variation 2, it is possible to prevent a deterioration in the display panel 2 while reducing electric power consumption. Therefore, a quality of a displayed image will never be deteriorated. Furthermore, in first and second driving periods, it is possible to prevent occurrence of an afterimage of the displayed image.

Embodiment 2

The following description will discuss Embodiment 2 of the present invention with reference to FIGS. 6 through 10. Note that identical reference numerals will be given to respective members common to Embodiments 1 and 2, and the members will not be described in detail. Embodiment 2 is different from Embodiment 1 in that an image signal, having an identical polarity, is supplied to a display panel 2 in each frame which makes up a first driving period. In regard to the other points, Embodiment 2 is similar to Embodiment 1.

(Details of Driving Control)

FIG. 6 is a timing diagram illustrating, in detail, how control is carried out in each frame while a display device in accordance with Embodiment 2 of the present invention is in operation.

According to an example illustrated in FIG. 6, a first driving period, in which an image "A" is displayed, is made up of the third frame. That is, in the third frame, a displayed image "A" is changed to an image "Z." In the third frame, a source diver 6 supplies, to the display panel 2, an image signal, having a polarity identical to that of pixel applied voltages in the second frame. This causes the pixel applied voltages in the third frame to be identical to those in the second frame. That is, merely the displayed image is changed, and there is no change in pixel applied voltages.

In the sixth frame, an image signal supplied to a timing controller 8 via an interface 12 matches the image signal stored in a frame memory 10, and a polarity balance value is "0 (zero)", which is a reference value. Therefore, the seventh frame is set so as to make up a second driving period in which the image "A" is displayed. As a result, in the seventh frame, the source driver 6 supplies, to the display panel 2, the image signal which has the polarity opposite to that of the pixel applied voltages in the sixth frame and which indicates the image "A". This causes the pixel applied voltages to have a positive (+) polarity in the seventh frame.

In the ninth frame, an image signal supplied to the timing controller 8 via the interface 12 does not match the image signal stored in the frame memory 10. Therefore, the tenth frame is set so as to make up a second driving period in which an image "B" is displayed. As a result, in the tenth frame, the source driver 6 supplies, to the display panel 2, the image signal which has a polarity identical to that of the pixel applied voltages in the ninth frame and which indicates the image "B". This causes the pixel applied voltages to have the positive (+) polarity in the tenth frame.

In the fourteenth frame, an image signal supplied to the timing controller 8 via the interface 12 matches the image signal stored in the frame memory 10, and the polarity balance value is "8", which is the reference value. Therefore, the fifteenth frame is set so as to make up a second driving period in which the image "B" is displayed. As a result, in the fifteenth frame, the source driver 6 supplies, to the display panel 2, the image signal which has the polarity opposite to that of the pixel applied voltages in the fourteenth frame and which indicates the image "B". This causes (i) display refresh to be carried out and (ii) the pixel applied voltages to have the negative (−) polarity in the seventh frame.

In the twenty-third frame, an image signal supplied to the timing controller 8 via the interface 12 matches the image signal stored in the frame memory 10, and the polarity balance value is "0 (zero)", which is the reference value. Therefore, the twenty-third frame is set so as to make up a second driving period in which the image "B" is displayed. As a result, in the fifteenth frame, the source driver 6 supplies, to the display panel 2, the image signal which has the polarity opposite to that of the pixel applied voltages in the fourteenth frame and which indicates the image "B". This causes (i) the display refresh to be carried out and (ii) the pixel applied voltages to have the positive (+) polarity in the seventh frame.

As is clear from FIG. 6, in Embodiment 2, the pixel applied voltages continue to have a positive (+) or negative (−) polarity, unless the polarity balance value is equal to the reference value.

(Operation and Effects)

In Embodiment 2, similar to Embodiment 1, it is possible to prevent a deterioration in the display panel 2 while reducing electric power consumption. Therefore, a quality of a displayed image will never be deteriorated.

(Storage of Image Signal)

The display device 1 in accordance with Embodiment 2 can be alternatively arranged such that, in a current frame, an image signal supplied to the timing controller 8 is absolutely stored in the frame memory 10. In this case, regardless of whether the image signal supplied to the timing controller 8 matches or does not match that stored in the frame memory 10 in the current frame, the image signal supplied to the timing controller 8 is absolutely stored in the frame memory 10.

[Variation 1]

The following description will discuss Variation 1 of Embodiment 2. Configurations in Variation 1 which are identical to those in Embodiment 2 will not be described in detail.

FIG. 7 is a timing diagram illustrating, in detail, how control is carried out in each frame while a display device 1 in accordance with Variation 1 of Embodiment 2 of the present invention is in operation. According to an example illustrated in FIG. 7, a first driving period is made up of a plurality of frames. Specifically, a first driving period, in which an image "A" is displayed, is made up of the third frame through the fifth frame. A first driving period, in which an image "B" is displayed, is made up of the tenth frame through the twelfth frame.

In the second frame, a timing controller 8 sets the first driving period made up of three successive scanning frames, i.e., the third frame (which follows the second frame) and succeeding frames. This causes a display panel 2 to be driven not only in the third frame but also in the fourth and fifth frames.

A source driver 6 supplies an image signal, having an identical polarity, to the display panel 2 in each frame in the first driving period in which the image "A" is displayed. Specifically, the source driver 6 supplies an image signal, having a polarity identical to that of pixel applied voltages in the second frame, to the display panel 2 in each of the third frame through the fifth frame. This causes the pixel applied voltages to have a negative (−) polarity without change in each of the third frame through the fifth frame, as well as that of the pixel applied voltages in the second frame. That is, in each of the third frame through the fifth frame, display refresh is carried out, but there is no change in displayed image and pixel applied voltages.

The source driver 6 supplies an image signal, having an identical polarity, to the display panel 2 in each frame in the first driving period in which the image "B" is displayed. Specifically, the source driver 6 supplies an image signal, having a polarity identical to that of the pixel applied voltages in the ninth frame, to the display panel 2 in each of the tenth frame through the twelfth frame. This causes the pixel applied voltages to have a positive (+) polarity without change in each of the tenth frame through the twelfth frame, as well as that of the pixel applied voltages in the ninth frame. That is, in each of the third frame through the fifth frame, the display refresh is carried out, but there is no change in displayed image and pixel applied voltages.

(Operation and Effects)

In Variation 1, similar to Embodiment 1, it is thus possible to prevent a deterioration in the display panel 2 while reducing electric power consumption. Therefore, a quality of a displayed image will never be deteriorated. In addition, in Variation 1, a first driving period is made up of a plurality of successive frames. That is, in the first driving period, one and the same image is continuously displayed over the plurality of successive frames. This makes it possible to prevent occurrence of an afterimage of the displayed image in the first driving period.

[Variation 2]

The following description will discuss Variation 2 of Embodiment 2. Configurations in Variation 2 which are identical to those in Variation 1 will not be described in detail.

FIG. 8 is a timing diagram illustrating, in detail, how control is carried out in each frame while a display device 1 in accordance with Variation 2 of Embodiment 2 of the present invention is in operation. According to an example illustrated in FIG. 8, a first driving period is made up of a plurality of frames. Specifically, a first driving period, in which an image "A" is displayed, is made up of the third frame through the fifth frame. A first driving period, in which an image "B" is displayed, is made up of the tenth frame through the twelfth frame.

A second driving period is made up of a plurality of frames. Specifically, a second driving period, in which the image "A" is displayed, is made up of the seventh frame through the ninth frame. A second driving period, in which the image "B" is displayed, is made up of the fifteenth frame through the seventeenth frame. Another second driving period, in which the image "B" is displayed, is made up of the twenty-third frame through the twenty-fifth frame.

Processes carried out in the first frame through the seventh frame in Variation 2 are basically identical to those carried out in the first frame through the seventh frame in Variation 1. Note, however, that, in the sixth frame, a timing controller 8 sets the second driving period made up of three successive scanning frames, i.e., the seventh frame (which follows the sixth frame) and succeeding frames. This causes a display panel 2 to be driven not only in the seventh frame but also in the eighth frame through the ninth frame.

A source driver 6 supplies an image signal, having an identical polarity, to the display panel 2 in each frame in the second driving period in which the image "A" is displayed. Specifically, the source driver 6 supplies an image signal, having a polarity opposite to that of pixel applied voltages in the sixth frame, to the display panel 2 in each of the seventh frame through the ninth frame. This causes the pixel applied voltages to have a positive (+) polarity without change in each of the seventh frame through the ninth frame, unlike that of the pixel applied voltages in the second frame. That is, in each of the seventh frame through the ninth frame, display refresh is carried out, but there is no change in displayed image and pixel applied voltages.

The source driver 6 supplies an image signal, having an identical polarity, to the display panel 2 in each frame in the first driving period in which the image "B" is displayed. Specifically, the source driver 6 supplies an image signal, having a polarity opposite to that of the pixel applied voltages in the fourteenth frame, to the display panel 2 in each of the fifteenth frame through the seventeenth frame. This causes the pixel applied voltages to have a negative (−) polarity without change in each of the fifteenth frame through the seventeenth frame, unlike that of the pixel applied voltages in the fourteenth frame. That is, in each of the fifteenth frame through the seventeenth frame, the display refresh is carried out, but there is no change in displayed image and pixel applied voltages.

Meanwhile, the source driver 6 supplies the image signal, having an identical polarity, to the display panel 2 in each frame in the another first driving period in which the image "B" is displayed. Specifically, the source driver 6 supplies the image signal, having a polarity opposite to that of the pixel applied voltages in the twenty-second frame, to the display panel 2 in each of the twenty-third frame through the twenty-fifth frame. This causes the pixel applied voltages to have the positive (+) polarity without change in each of the twenty-third frame through the twenty-fifth frame, unlike that of the pixel applied voltages in the twenty-second frame. That is, in each of the twenty-third frame through the twenty-fifth frame, the display refresh is carried out, but there is no change in displayed image and pixel applied voltages.

(Operation and Effects)

In Variation 2, similar to Variation 1, it is thus possible to prevent a deterioration in the display panel 2 while reducing electric power consumption. Therefore, a quality of a displayed image will never be deteriorated. Furthermore, in a first driving period, it is possible to prevent occurrence of an afterimage of the displayed image. In addition, in Variation 2, a second driving period is made up of a plurality of successive frames. That is, in the second driving period, one and the same image is continuously displayed over the plurality of successive frames. This makes it possible to prevent occurrence of an afterimage of the displayed image in the second driving period.

Embodiment 3

Figure 9:
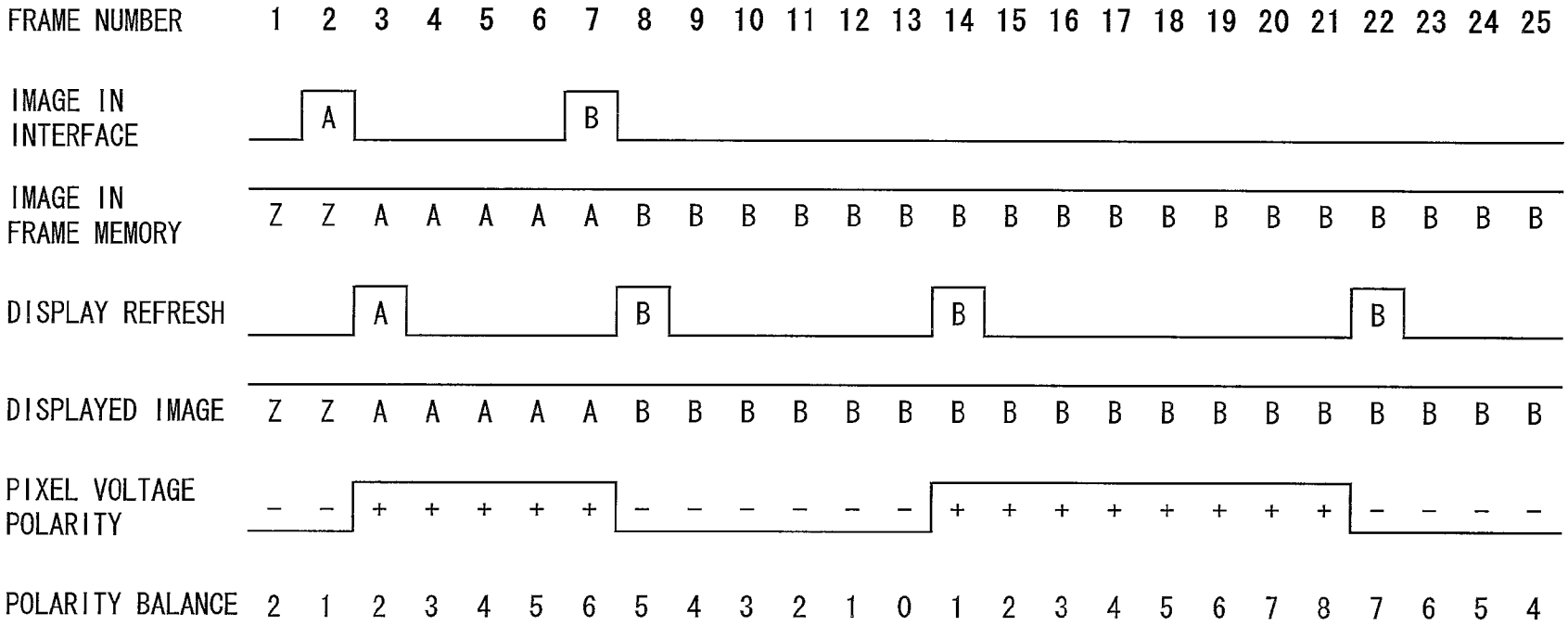
FIG. 9 is a timing diagram illustrating, in detail, how control is carried out in each frame while a display device in accordance with Embodiment 3 of the present invention is in operation.

The following description will discuss Embodiment 3 of the present invention with reference to FIG. 9. Note that identical reference numerals will be given to respective members common to Embodiment 3 and Embodiment 1 or 2, and the members will not be described in detail.

Embodiment 3 is different from Embodiment 1 in that, merely in a case where an image signal corresponding to each frame is different from that corresponding to a frame which comes one (1) frame before the each frame, a host 14 supplies the image signal corresponding to the each frame to a timing controller 8 via an interface 12. In regard to the other points, Embodiment 3 is basically identical to Embodiment 1.

(Details of Driving Control)

FIG. 9 is a timing diagram illustrating, in detail, how control is carried out in each frame while a display device in accordance with Embodiment 3 of the present invention is in operation.

In Embodiment 3, the host 14 determines, in each frame, whether or not an image signal corresponding to a current frame matches that corresponding to a frame which comes one (1) frame before the current frame, before supplying the image signal corresponding to the current frame to the timing controller 8. In a case where the host 14 determines that the image signal corresponding to the current frame matches that corresponding to the frame which comes one (1) frame before the current frame, the host 14 does not supply, in the current frame, the image signal corresponding to the current frame to the timing controller 8. On the other hand, in a case where the host 14 determines that the image signal corresponding to the current frame does not match that corresponding to the frame which comes one (1) frame before the current frame, the host 14 supplies, in the current frame, the image signal corresponding to the current frame to the timing controller 8. That is, an image signal is supplied to the timing controller 8 merely in a frame in which the image signal is changed from that corresponding to a frame which comes one (1) frame before the frame. In the other frames, the interface 12 is not operated, and no image signal is supplied to the timing controller 8.

According an example illustrated in FIG. 9, the hose 14 supplies an image signal to the timing controller 8 in each of the second frame and the seventh frame. In the other frames, the host 14 does not supply an image signal to the timing controller 8.

In a frame in which display refresh is necessitated, the display device 1 drives the display panel 2 with the absolute use of an image signal stored in a frame memory 10. This is because, in the frame in which the display refresh is necessitated, no image signal is supplied to the timing controller 8 via the interface 12. An image signal, that can be thus used to drive the display panel 2, is limited to that stored in the frame memory 10.

In Embodiment 3, similar to Embodiment 1, it is possible to prevent a deterioration in the display panel 2 while reducing electric power consumption. Therefore, a quality of a displayed image will never be deteriorated. In addition, it is possible to reduce electric power consumed by the interface 12. This allows a further reduction in electric power consumed by the display panel 1, as compared with that of Embodiment 1.

Note that configurations described in Embodiment 3 are applicable to Embodiments 1 and 2. Furthermore, the configurations described in Embodiment 3 are applicable to Variations 1 through 3 of Embodiment 1 as well as Variations 1 and 2 of Embodiment 2.

(Storage of Image Signal)

The display device 1 of Embodiment 3 can be alternatively arranged such that, in a current frame, an image signal supplied to the timing controller 8 is absolutely stored in the frame memory 10. In this case, regardless of whether the image signal supplied to the timing controller 8 matches or does not match that stored in the frame memory 10 in the current frame, the image signal supplied to the timing controller 8 is absolutely stored in the frame memory 10.

Embodiment 4

The following description will discuss Embodiment 4 of the present invention with reference to FIG. 10. Note that identical reference numerals will be given to respective members common to Embodiment 4 and Embodiments 1 through 3, and the members will not be described in detail.

Embodiment 4 is different from Embodiment 1 in that display refresh is immediately carried out in a frame in which a host 14 supplies an image signal to a timing controller 8. In regard to the other points, Embodiment 4 is basically identical to Embodiment 3.

(Details of Driving Control)

FIG. 10 is a timing diagram illustrating, in detail, how control is carried out in each frame while a display device 1 in accordance with Embodiment 4 of the present invention is in operation. According to an example illustrated in FIG. 10, a host 14 supplies an image signal to a timing controller 8 in each of the second frame and seventh frame. In each frame other than the second and seventh frames, the host 14 does not supply an image signal to the timing controller 8. That is, an interface 12 is stopped.

The display panel 1 is arranged such that display refresh is immediately carried out in a frame in which the host 14 supplies an image signal to the timing controller 8. In doing so, a display panel 2 is driven with the use of the image signal received by the timing controller 8 from the host 14, instead of an image signal stored in a frame memory 10. Note that, in the frame, the timing controller 8 writes, in the frame memory 10, the image signal supplied from the host 14.

In the second frame, an image signal indicative of an image "A" is supplied to the timing controller 8. In the second frame, a source driver 6 supplies the image signal to the display panel 2. As a result, in the second frame, a displayed image is changed to the image "A." Meanwhile, in the seventh frame, an image signal indicative of an image "B" is supplied to the timing controller 8. In the seventh frame, the source driver 6 supplies the image signal to the display panel 2. As a result, in the seventh frame, the displayed image is changed to the image "B."

The display device 1 drives the display panel 2 with the use of an image signal stored in the frame memory 10, in a frame (thirteenth frame and the twenty-first frame) which follows a frame in which a polarity balance value is equal to a reference value. This is because, in each of the thirteenth frame and the twenty-first frame, no image signal is supplied to the timing controller 8 via the interface 12. That is, an image signal, that can be used to drive the display panel 2, is limited to that stored in the frame memory 10.

(Operation and Effects)

In Embodiment 4, similar to Embodiment 1, it is possible to prevent a deterioration in the display panel 2 while reducing electric power consumption. Therefore, a quality of a displayed image will never be deteriorated. In addition, it is possible to reduce electric power consumed by the interface 12. This allows a further reduction in electric power consumed by the display device 1, as compared with that of Embodiment 1. Furthermore, in a case where display refresh is necessitated in a first driving period, it is not necessary to access the frame memory 10. It is therefore possible to reduce more electric power consumption, as compared with a case where the frame memory 10 is accessed.

Note that configurations described in Embodiment 4 are applicable to Embodiments 1 and 2. Furthermore, the configurations described in Embodiment 4 are applicable to those of Variations 1 through 3 of Embodiment 1 as well as those of Variations 1 and 2 of Embodiment 2.

(Storage of Image Signal)

The display device 1 of Embodiment 4 can be alternatively arranged such that, in a current frame, an image signal supplied to the timing controller 8 is absolutely stored in the frame memory 10. In this case, regardless of whether the image signal supplied to the timing controller 8 matches or does not match that stored in the frame memory 10 in the current frame, the image signal supplied to the timing controller 8 is absolutely stored in the frame memory 10.

[Details of TFT 30]

According to the display device 1 of each of the foregoing Embodiments and Variations, a TFT, in which a so-called oxide semiconductor is employed as a semiconductor layer, is employed as the TFT 30 in each of the plurality of pixels included in the display panel 2. In particular, a TFT 30 is employed in which so-called "InGaZnOx" is employed as a semiconductor layer. The "InGaZnOx" is an oxide made up of indium (In), gallium (Ga), and zinc (Zn). The TFT 30, in which the oxide semiconductor is employed, will be described below in terms of its advantages.

Figure 11:
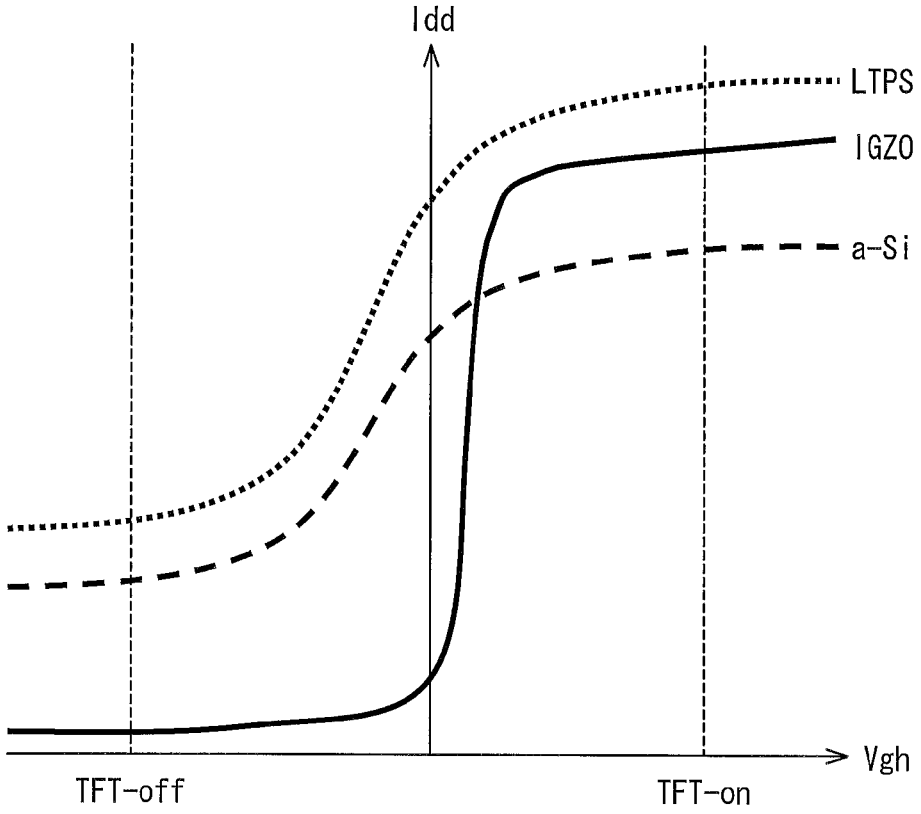
FIG. 11 is a view illustrating characteristics of various TFTs, such as a TFT in which an oxide semiconductor is employed.

FIG. 11 is a view illustrating characteristics of various TFTs, such as the TFT 30 in which the oxide semiconductor is employed. FIG. 11 shows characteristics of (i) the TFT 30 in which the oxide semiconductor is employed, (ii) a general TFT in which a-Si (amorphous silicon) is employed, and (iii) a general TFT in which LTPS (Low Temperature Poly Silicon) is employed.

In FIG. 11, a horizontal axis (Vgh) indicates each on-voltage applied to a gate of a corresponding one of the TFTs. A vertical axis (Id) indicates each electric current flowing between a source and a drain of a corresponding one of the TFTs. A period "TFT-on" indicates a time period in which each of the TFTs is tuned on in response to a corresponding on-voltage. A period "TFT-off" indicates a time period in which each of the TFTs is tuned off in response to a corresponding on-voltage.

(On-Characteristic)

The TFT in which the oxide semiconductor is employed is higher in electron mobility while being turned on, as compared with the TFT in which a-Si is employed (see FIG. 11). Specifically, in a case of the TFT in which a-Si is employed, an Id electric current is 1 (one) uA (not illustrated) while the TFT is being turned on. In contrast, in a case of the TFT in which the oxide semiconductor is employed, an Id electric current is approximately 20 uA to 50 uA (not illustrated) while the TFT is being turned on. It is therefore understood that the TFT, in which the oxide semiconductor is employed, is (i) approximately 20 times to 50 times as high as the TFT in which a-Si is employed, in terms of electron mobility in an on-state and (ii) accordingly extremely excellent in on-characteristic.

According to the display device 1 of the foregoing embodiments, each of the plurality of pixels employs a TFT 30 in which the oxide semiconductor is employed. According to the display device 1 of the foregoing embodiments, since the TFT 30 is excellent in on-characteristic, it is possible to drive each of the plurality of pixels with the use of the TFT 30 which is smaller in size than the others. This allows a reduction in proportion of an area which is occupied by the TFT 30 in each of the plurality of pixels. That is, it is possible to increase an aperture ratio of each of the plurality of pixels, and is accordingly possible to increase transmittance of the each of the plurality of pixels with respect to backlight. As a result, it is possible to (i) employ a backlight which consumes less electric power and/or (ii) suppress luminance of backlight. This allows a reduction in electric power consumption.

Furthermore, since the TFT 30 is excellent in on-characteristic, it is possible to shorten time required for an image signal to be written in the plurality of pixels. This makes it possible to easily increase a refresh rate of the display panel 2.

(Off-Characteristic)

The TFT 30, in which the oxide semiconductor is employed, is lower in leak current while being turned off, as compared with the TFT in which a-Si is employed (see FIG. 11). Specifically, in a case of the TFT in which a-Si is employed, an Id electric current is 10 pA (not illustrated) while the TFT is being turned off. In contrast in a case of the TFT 30, in which the oxide semiconductor is employed, an Id electric current is approximately 0.1 pA (not illustrated) while the TFT is being turned off.

It is therefore understood that the TFT 30, in which the oxide semiconductor is employed, (i) is approximately a hundredth (1/100) as low as the TFT in which a-Si is employed, in terms of a leak current in an off-state and (ii) is accordingly extremely excellent in off-characteristic because the leak current hardly occurs. According to the display device 1 of the foregoing embodiments, since the TFT 30 is thus excellent in off-characteristic, it is possible to maintain, for a long time period, a state where an image signal is being written in the plurality of pixels of the display panel 2. It is therefore possible to maintain, for a long time period, a frame in which no image signal is written in the display panel 2, while maintaining a high display quality.

The present invention is not limited to the description of the embodiments, but may be altered by a skilled person in the art within the scope of the claims. That is, within the scope of the claims, a new embodiment will be derived from a combination of technical means altered as appropriate.

(Reference Value of Polarity Balance Value)

The reference value of the polarity balance value is not limited to "0 (zero)" or "8", and can be alternatively set to any value. The reference value can be, for example, a negative value such as "−5".

(Number of Frames Making Up Driving Period)

The number of scanning frames, which make up a first driving period, is not limited to one or three, and can be alternatively set to any number. The number of the scanning frames is preferably not less than one and not more than six. The number of scanning frames, which make up a second driving period, is not limited to one or three, and can be alternatively set to any number. The number of the scanning frames is preferably not less than one and not more than six.

[Summary]

In order to attain the above object, a method of driving a display device in accordance with an aspect of the present invention is a method of driving a display device which includes a display panel having pixels and which is configured such that (i) a scanning signal and an image signal are supplied to the display panel in a scanning frame and (ii) no scanning signal and no image signal are supplied to the display panel in a pause frame, the method including:

supplying an image signal, having a polarity opposite to that of voltages applied to the respective pixels in a current frame, to the display panel in a next frame, in a case where a polarity balance value, indicative of a polarity balance of the pixels in the current frame, is equal to a predetermined reference value.

According to the above configuration, by not driving the display panel in the pause frame, it is possible to reduce electric power consumed by the display device. In a case where the polarity balance value in the current frame is equal to the reference value, the voltages applied to the respective pixels have a reversed polarity in the next frame. Therefore, even in a case where pause frames continue for a long time period, the polarity of such pixel applied voltages does not continue to be biased to positive or negative. In other words, it is possible to maintain, within a given range, a polarity balance of the pixel applied voltages.

Thus, according to the method of driving a display device in accordance with an aspect of the present invention, it is possible to prevent a deterioration in the display panel while reducing electric power consumption.

In order to attain the above object, a display device in accordance with an aspect of the present invention is a display device which includes a display panel having pixels and which is configured such that (i) a scanning signal and an image signal are supplied to the display panel in a scanning frame and (ii) no scanning signal and no image signal are supplied to the display panel in a pause frame, the display device further including:

a supplying section for supplying an image signal, having a polarity opposite to that of voltages applied to the respective pixels in a current frame, to the display panel in a next frame, in a case where a polarity balance value, indicative of a polarity balance of the pixels in the current frame, is equal to a predetermined reference value.

According to the above configuration, it is possible to bring about effects similar to those brought about by the method of driving a display device in accordance with the present invention.

The method of driving a display device in accordance with an aspect of the present invention is preferably arranged such that:

in a case where a first image signal corresponding to the current frame does not match a second image signal corresponding to a previous frame, the first image signal is supplied to the display panel in a first driving period made up of at least one successive frame, i.e., the next frame only or the next frame and succeeding frame(s);

in a case where (i) the first image signal matches the second image signal and (ii) the polarity balance value is equal to the predetermined reference value, the second image signal is supplied to the display panel in a second driving period made up of the at least one successive frame, i.e., the next frame only or the next frame and the succeeding frame(s), the second image signal being supplied to the display panel in the next frame in the second driving period, which second image signal has a polarity opposite to that of the voltages applied to the respective pixels in the current frame; and in a frame which is not included in any of the first driving period and the second driving period, no image signal is supplied to the display panel.

According to the above configuration, in a case where a given condition is satisfied, the first driving period and the second driving period are set. A frame, which makes up the first or second driving period, is a scanning frame. On the other hand, a frame, other than the frame which makes up the first or second driving period, is a pause frame. That is, even in a case where the scanning frame and the pause frame are not individually specified in advance, they are automatically set.

Here, in a case where the polarity balance value is equal to the reference value in the first frame of the second driving period, the voltages applied to the respective pixels have a reversed polarity in the next frame in the second driving period. It is therefore possible to maintain, within the given range, the polarity balance of the pixel applied voltages.

The method of driving a display device in accordance with an aspect of the present invention is preferably arranged such that:

the display device further includes a timing controller and a frame memory having a region in which an image signal, corresponding to at least one frame, is stored;

in the current frame, in a case where an image signal, newly supplied to the timing controller, matches that stored in the frame memory, the image signal thus newly supplied is not written in the frame memory;

in the current frame, in a case where the image signal, newly supplied to the timing controller, does not match that stored in the frame memory, the image signal thus newly supplied is written in the frame memory; and in the scanning frame, in a case where the image signal, newly supplied to the timing controller, matches that stored in the frame memory, the image signal stored in the frame memory is supplied to the display panel.

According to the above configuration, even in a case where a supply frequency at which an image signal is supplied to the timing controller is not identical to a supply frequency at which the image signal is supplied to the display panel, the display panel is capable of normally displaying an image.

The method of driving a display device in accordance with an aspect of the present invention is preferably arranged such that:

in a case where the voltages applied to the respective pixels have a positive polarity in the current frame, a certain value is added to the polarity balance value;

whereas, in a case where the voltages applied to the respective pixels have a negative polarity in the current frame, the certain value is subtracted from the polarity balance value.

According to the above configuration, it is possible to promptly calculate the polarity balance value in each frame.

The display device in accordance with an aspect of the present invention is preferably arranged such that the second driving period is made up of a plurality of frames.

According to the above configuration, it is possible to prevent occurrence of an afterimage of a displayed image.

The display device in accordance with an aspect of the present invention is preferably arranged such that the second image signal is supplied, in the second driving period, to the display panel while the second image signal has the polarity which is reversed for each frame.

According to the above configuration, it is possible to further prevent a deterioration in the display panel.

The method of driving a display device in accordance with an aspect of the present invention is preferably arranged such that the second image signal, having an identical polarity, is supplied to the display panel in each of the plurality of frames in the second driving period.

According to the above configuration, it is possible to further prevent occurrence of an afterimage of a displayed image.

The method of driving a display device in accordance with an aspect of the present invention is preferably arranged such that the first driving period is made up of a plurality of frames.

According to the above configuration, it is possible to prevent occurrence of an afterimage of a displayed image.

The method of driving a display device in accordance with an aspect of the present invention is preferably arranged such that the first image signal is supplied, in the first driving period, to the display panel while the first image signal has a polarity which is reversed for each frame.

According to the above configuration, it is possible to further prevent a deterioration in the display panel.

The method of driving a display device in accordance with an aspect of the present invention is preferably arranged such that the first image signal, having an identical polarity, is supplied to the display panel in each of the plurality of frames in the first driving period.

According to the above configuration, it is possible to further prevent occurrence of an afterimage of a displayed image.

The method of driving a display device in accordance with an aspect of the present invention is preferably arranged such that:

the display device further includes (i) an interface via which an image signal is supplied to the timing controller and (ii) a host which supplies the image signal to the timing controller via the interface;

in a case where the first image signal does not match the second image signal, the first image signal is supplied to the timing controller;

in a case where the first image signal matches the second image signal, the first image signal is not supplied to the timing controller; and in a case where a given frame in which the host does not supply any image signal to the timing controller is included in the second driving period, the image signal stored in the frame memory is supplied to the display panel in the given frame.

According to the above configuration, merely in a case where an image signal corresponding to the current frame is different from that corresponding to the previous frame, the image signal corresponding to the current frame is supplied to the timing controller from the host. It is therefore possible to reduce electric power consumed by the interface, as compared with a case where an image signal is absolutely supplied to the timing controller in each frame.

Furthermore, in a frame in which (i) an image signal corresponding to the frame matches that corresponding to the previous frame but (ii) display refresh on the display panel is necessitated, an image signal stored in the frame memory is supplied to the display panel. Therefore, even in a case where no image signal is supplied to the timing controller via the interface, it is possible to normally carry out the display refresh.

The method of driving a display device in accordance with an aspect of the present invention is preferably arranged such that, in a case where another given frame in which the host supplies the image signal to the timing controller is included in the first driving period, the image signal supplied from the host is supplied to the display panel in the another given frame.

According to the above configuration, in a case where the display refresh is necessitated in the first driving period, it is not necessary to access the frame memory. It is therefore possible to reduce electric power consumption, as compared with a case where the frame memory is accessed.

The method of driving a display device in accordance with an aspect of the present invention is preferably arranged such that an oxide semiconductor is employed as a semiconductor layer of a TFT in each of the pixels. Especially, the oxide semiconductor is preferably an oxide made up of indium, gallium, and zinc.

According to the above configuration, since the TFT in each of the pixels is excellent in off-characteristic, it is possible to maintain, for a long time, a state where an image signal is being written in the pixels of the display panel. It is therefore possible to maintain pause frames for a long time period while maintaining a high display quality.

The display device in accordance with an aspect of the present invention is preferably arranged such that the display device is a liquid crystal display device.

According to the above configuration, it is possible to realize a liquid crystal display device capable of preventing a deterioration in a display panel while reducing electric power consumption.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

INDUSTRIAL APPLICABILITY

The display device in accordance with the present invention can be widely employed as various display devices such as a liquid crystal display device.

REFERENCE SIGNS LIST

1 Display device
2 Display panel
4 Gate driver (driving section, output section)
6 Source Driver (driving section)
8 Timing controller (writing section)
10 Frame memory
12 Interface
14 Host
20 Image signal determining part (image signal determining section)
22 Polarity balance determining part (calculating section, polarity balance determining section)
24 Polarity designating part
30 TFT (switching element)

The invention claimed is:

1. A method of driving a display device which includes a display panel having pixels and which is configured such that (i) a scanning signal and an image signal are supplied to the display panel in a scanning frame and (ii) no scanning signal and no image signal are supplied to the display panel in a pause frame, the method comprising:

supplying an image signal, having a polarity opposite to that of voltages applied to the respective pixels in a current frame, to the display panel in a next frame, in a case where a polarity balance value, indicative of a polarity balance of the pixels in the current frame, is equal to a predetermined reference value, wherein:

in a case where a first image signal corresponding to the current frame does not match a second image signal corresponding to a previous frame, the first image signal is supplied to the display panel in a first driving period made up of at least one successive frame, i.e., the next frame only or the next frame and succeeding frame(s);

in a case where (i) the first image signal matches the second image signal and (ii) the polarity balance value is equal to the predetermined reference value, the second image signal is supplied to the display panel in a second driving period made up of the at least one successive frame, i.e., the next frame only or the next frame and the succeeding frame(s), the second image signal being supplied to the display panel in the next frame in the second driving period, which second image signal has a polarity opposite to that of the voltages applied to the respective pixels in the current frame; and in a frame which is not included in any of the first driving period and the second driving period, no image signal is supplied to the display panel.

2. The method as set forth in claim 1, wherein:

the display device further includes a timing controller and a frame memory having a region in which an image signal, corresponding to at least one frame, is stored;

in the current frame, in a case where an image signal, newly supplied to the timing controller, matches that stored in the frame memory, the image signal thus newly supplied is not written in the frame memory;

in the current frame, in a case where the image signal, newly supplied to the timing controller, does not match that stored in the frame memory, the image signal thus newly supplied is written in the frame memory; and in the scanning frame, in a case where the image signal, newly supplied to the timing controller, matches that stored in the frame memory, the image signal stored in the frame memory is supplied to the display panel.

3. The method as set forth in claim 2, wherein:

the display device further includes (i) an interface via which an image signal is supplied to the timing controller and (ii) a host which supplies the image signal to the timing controller via the interface;

in a case where the first image signal does not match the second image signal, the first image signal is supplied to the timing controller;

in a case where the first image signal matches the second image signal, the first image signal is not supplied to the timing controller; and in a case where a given frame in which the host does not supply any image signal to the timing controller is included in the second driving period, the image signal stored in the frame memory is supplied to the display panel in the given frame.

4. The method as set forth in claim 3, wherein, in a case where another given frame in which the host supplies the image signal to the timing controller is included in the first driving period, the image signal supplied from the host is supplied to the display panel in the another given frame.

5. The method as set forth in claim 1, wherein:

in a case where the voltages applied to the respective pixels have a positive polarity in the current frame, a certain value is added to the polarity balance value;

whereas, in a case where the voltages applied to the respective pixels have a negative polarity in the current frame, the certain value is subtracted from the polarity balance value.

6. The method as set forth in claim 1, wherein the second driving period is made up of a plurality of frames.

7. The method as set forth in claim 6, wherein the second image signal is supplied, in the second driving period, to the display panel while the second image signal has the polarity which is reversed for each frame.

8. The method as set forth in claim 6, wherein the second image signal, having an identical polarity, is supplied to the display panel in each of the plurality of frames in the second driving period.

9. The method as set forth in claim 1, wherein the first driving period is made up of a plurality of frames.

10. The method as set forth in claim 9, wherein the first image signal is supplied, in the first driving period, to the display panel while the first image signal has a polarity which is reversed for each frame.

11. The method as set forth in claim 9, wherein the first image signal, having an identical polarity, is supplied to the display panel in each of the plurality of frames in the first driving period.

12. The method as set forth in claim 1, wherein an oxide semiconductor is employed as a semiconductor layer of a TFT in each of the pixels.

13. The method as set forth in claim 12, wherein the oxide semiconductor is an oxide made up of indium, gallium, and zinc.

14. A method of driving a display device which includes a display panel having pixels and which is configured such that (i) a scanning signal and an image signal are supplied to the display panel in a scanning frame and (ii) no scanning signal and no image signal are supplied to the display panel in a pause frame, the method comprising:

supplying an image signal, having a polarity opposite to that of voltages applied to the respective pixels in a current frame, to the display panel in a next frame, in a case where a polarity balance value, indicative of a polarity balance of the pixels in the current frame, is equal to a predetermined reference value, wherein:

in a case where the voltages applied to the respective pixels have a positive polarity in the current frame, a certain value is added to the polarity balance value;

whereas, in a case where the voltages applied to the respective pixels have a negative polarity in the current frame, the certain value is subtracted from the polarity balance value.

* * * * *